US011325376B2

(12) United States Patent
Kashimura et al.

(10) Patent No.: US 11,325,376 B2
(45) Date of Patent: May 10, 2022

(54) DRIVE CIRCUIT AND LIQUID EJECTING APPARATUS

(71) Applicant: Seiko Epson Corporation, Tokyo (JP)

(72) Inventors: Toru Kashimura, Shiojiri (JP); Yoichiro Kondo, Chino (JP); Tetsuo Takagi, Okaya (JP)

(73) Assignee: Seiko Epson Corporation

( * ) Notice: Subject to any disclaimer, the term of this patent is extended or adjusted under 35 U.S.C. 154(b) by 0 days.

(21) Appl. No.: 17/032,084

(22) Filed: Sep. 25, 2020

(65) Prior Publication Data

US 2021/0094288 A1 Apr. 1, 2021

(30) Foreign Application Priority Data

Sep. 26, 2019 (JP) ..... JP2019-175248

(51) Int. Cl.
*B41J 29/38* (2006.01)
*B41J 2/045* (2006.01)

(52) U.S. Cl.
CPC ..... *B41J 2/04581* (2013.01); *B41J 2/0455* (2013.01)

(58) Field of Classification Search
CPC ..... B41J 2/0451; B41J 2/04588; B41J 2/0455
See application file for complete search history.

(56) References Cited

U.S. PATENT DOCUMENTS 9,669,621 B2 6/2017 Nozawa
9,937,712 B2 4/2018 Nozawa
2017/0182773 A1* 6/2017 Fujisawa ..... B41J 2/0451

FOREIGN PATENT DOCUMENTS

JP 2017-043007 A 3/2017

* cited by examiner

*Primary Examiner* — Lam S Nguyen
(74) *Attorney, Agent, or Firm* — Harness, Dickey & Pierce, P.L.C.

(57) ABSTRACT

A drive circuit includes a drive signal output circuit that outputs a drive signal supplied to the piezoelectric element and a first constant voltage signal that is constant at a first voltage value; a switch circuit having one end electrically coupled to an output terminal of the drive signal output circuit and the other end electrically coupled to the first terminal of the piezoelectric element, and a reference voltage signal output circuit that is electrically coupled to the second terminal of the piezoelectric element and outputs a second constant voltage signal which is constant at a second voltage value, in which before the reference voltage signal output circuit starts to output the second constant voltage signal, the one end and the other end of the switch circuit are controlled to be non-conductive, and the drive signal output circuit outputs the first constant voltage signal.

8 Claims, 20 Drawing Sheets

| | | LARGE DOT | MEDIUM DOT | SMALL DOT | MICRO-VIBRATION |
|---|---|---|---|---|---|
| [SIH, SIL] | | [1, 1] | [1, 0] | [0, 1] | [0, 0] |
| S | T1 | H | H | L | L |
| | T2 | H | L | H | L |
| | T3 | L | L | L | H |

DRIVE CIRCUIT AND LIQUID EJECTING APPARATUS

The present application is based on, and claims priority from JP Application Serial Number 2019-175248, filed Sep. 26, 2019, the disclosure of which is hereby incorporated by reference here in its entirety.

BACKGROUND

1. Technical Field

The present disclosure relates to a drive circuit and a liquid ejecting apparatus.

2. Related Art

It is known that an ink jet printer which is an example of a liquid ejecting apparatus ejecting a liquid such as ink to print an image or a document uses a piezoelectric element such as a piezo element. The piezoelectric element, which is included in a print head, is provided to correspond to a plurality of nozzles for ejecting ink and a cavity for storing the ink ejected from the nozzles. As the piezoelectric element is displaced according to a drive signal, a vibration plate provided between the piezoelectric element and the cavity bends, and a volume of the cavity changes. Thereby, a predetermined amount of ink is ejected from the nozzles at a predetermined timing, and dots are formed on a medium.

JP-A-2017-43007 discloses a piezoelectric element that displaces based on a potential difference between an upper electrode and a lower electrode, a drive signal generated based on printing data is supplied to the upper electrode, and a reference voltage is supplied to the lower electrode. A liquid ejecting apparatus is disclosed which controls displacement of the piezoelectric element by controlling whether or not the drive signal is supplied by a selection circuit (switch circuit) and ejects ink.

Before a piezoelectric element used in a liquid ejecting apparatus that ejects ink based on displacement of the piezoelectric element as described in JP-A-2017-43007 is incorporated in a print head, a polarization process of applying a predetermined DC electric field to a piezoelectric body of the piezoelectric element to align polarization directions is performed. Piezoelectric characteristics of the piezoelectric body are developed by the polarization process.

However, if an electric field in a direction opposite to the polarized DC electric field is supplied to the polarized piezoelectric element, disorder occurs in the polarization directions of the piezoelectric body aligned by the polarization process. The disorder in the polarization directions degrades the piezoelectric characteristics of the piezoelectric element, and as a result, there is a possibility that the piezoelectric element may perform an abnormal operation.

SUMMARY

In one aspect of a drive circuit according to the present disclosure, a drive circuit for driving a piezoelectric element having a first terminal and a second terminal, includes a drive signal output circuit that outputs a drive signal supplied to the piezoelectric element and a first constant voltage signal that is constant at a first voltage value, a switch circuit having one end electrically coupled to an output terminal of the drive signal output circuit and the other end electrically coupled to the first terminal, and a reference voltage signal output circuit that is electrically coupled to the second terminal and outputs a second constant voltage signal which is constant at a second voltage value, in which before the reference voltage signal output circuit starts to output the second constant voltage signal, the one end and the other end of the switch circuit are controlled to be non-conductive, and the drive signal output circuit outputs the first constant voltage signal.

In one aspect of the drive circuit, the drive signal output circuit may include a modulation circuit that modulates an original drive signal and outputs a modulation signal, an amplification circuit that amplifies the modulation signal and outputs an amplification modulation signal, a demodulation circuit that demodulates the amplification modulation signal and outputs the drive signal, and a constant voltage signal output circuit that outputs the first constant voltage signal.

In one aspect of the drive circuit, after the reference voltage signal output circuit starts to output the second constant voltage signal, the demodulation circuit may output the drive signal that is constant at a third voltage value.

In one aspect of the drive circuit, the demodulation circuit may output the drive signal of which voltage value for driving the piezoelectric element varies.

In one aspect of the drive circuit, a difference between the first voltage value and the second voltage value may be less than a difference between a maximum voltage value of the drive signal of which voltage value varies and the second voltage value.

In one aspect of the drive circuit, the difference between the first voltage value and the second voltage value may be less than a difference between a minimum voltage value of the drive signal of which voltage value varies and the second voltage value.

In one aspect of the drive circuit, the difference between the first voltage value and the second voltage value may be less than a difference between an average voltage value of the drive signal and the second voltage value.

In one aspect of the drive circuit, before the reference voltage signal output circuit starts to output the second constant voltage signal, a power supply voltage is supplied to the switch circuit.

One aspect of a liquid ejecting apparatus according to the present disclosure includes one aspect of the drive circuit, and a liquid ejecting head that includes a piezoelectric element and ejects a liquid by driving the piezoelectric element.

DESCRIPTION OF EXEMPLARY EMBODIMENTS

Hereinafter, preferred embodiments of the present disclosure will be described with reference to the drawings. The drawings are used for the sake of convenient description. The embodiments which will be described below do not unduly limit content of the present disclosure described in claims. Further, all configurations which will be described below are not necessarily essential configuration elements of the disclosure.

1. Configuration of Liquid Ejecting Apparatus

A printing apparatus which is an example of a liquid ejecting apparatus according to the present embodiment is an ink jet printer that prints an image including characters, figures, and the like according to image data onto a medium such as paper by ejecting ink from nozzles according to the image data input from an external host computer or the like.

Figure 1:
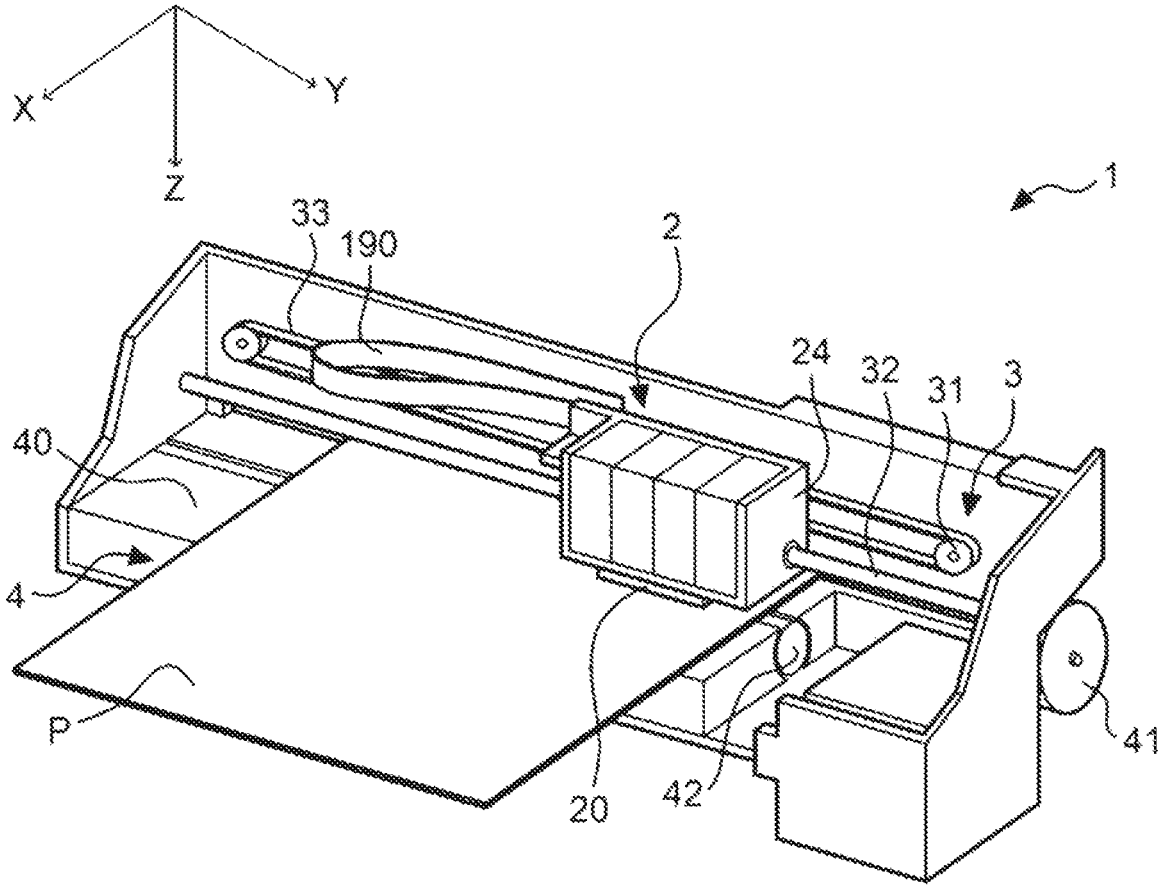
FIG. 1 is a diagram illustrating a configuration example of a liquid ejecting apparatus.

FIG. 1 is a diagram illustrating a configuration example of a liquid ejecting apparatus 1. FIG. 1 illustrates a direction X in which a medium P is transported, a direction Y which intersects with the direction X and in which a moving object 2 reciprocates, and a direction Z in which ink is ejected. Hereinafter, the direction X, the direction Y, and the direction Z are described as being orthogonal to each other, but a configuration included in the liquid ejecting apparatus 1 is not limited to being disposed to be orthogonal to each other. Further, in the following description, the direction Y in which the moving object 2 moves may be referred to as a main scanning direction.

As illustrated in FIG. 1, the liquid ejecting apparatus 1 includes the moving object 2 and a moving mechanism 3 that reciprocates the moving object 2 in the direction Y. The moving mechanism 3 includes a carriage motor 31 serving as a drive source of the moving object 2, a carriage guide shaft 32 having both ends fixed, and a timing belt 33 which extends substantially parallel to the carriage guide shaft 32 and is driven by the carriage motor 31.

The carriage 24 included in the moving object 2 is supported by a carriage guide shaft 32 so as to be able to reciprocate and is fixed to a part of the timing belt 33. The timing belt 33 is driven by the carriage motor 31, and thereby, the carriage 24 is guided by the carriage guide shaft 32 to reciprocate in the direction Y. Further, a head unit 20 including many nozzles is provided in a section of the moving object 2 facing the medium P. A control signal and the like are input to the head unit 20 via a cable 190. Then, the head unit 20 ejects ink which is an example of a liquid from the nozzles based on the control signal which is input.

The liquid ejecting apparatus 1 includes a transport mechanism 4 that transports the medium P on the platen 40 in the direction X. The transport mechanism 4 includes a transport motor 41 that is a drive source, and a transport roller 42 that is rotated by the transport motor 41 to transport the medium P in the direction X.

In the liquid ejecting apparatus 1 configured as described above, ink is ejected from the head unit 20 at a timing when the medium P is transported by the transport mechanism 4, and thereby, ink is landed at a desirable position of the medium P, and as a result, an image is formed on a surface of the medium P.

2. Electrical Configuration of Liquid Ejecting Apparatus

Figure 2:
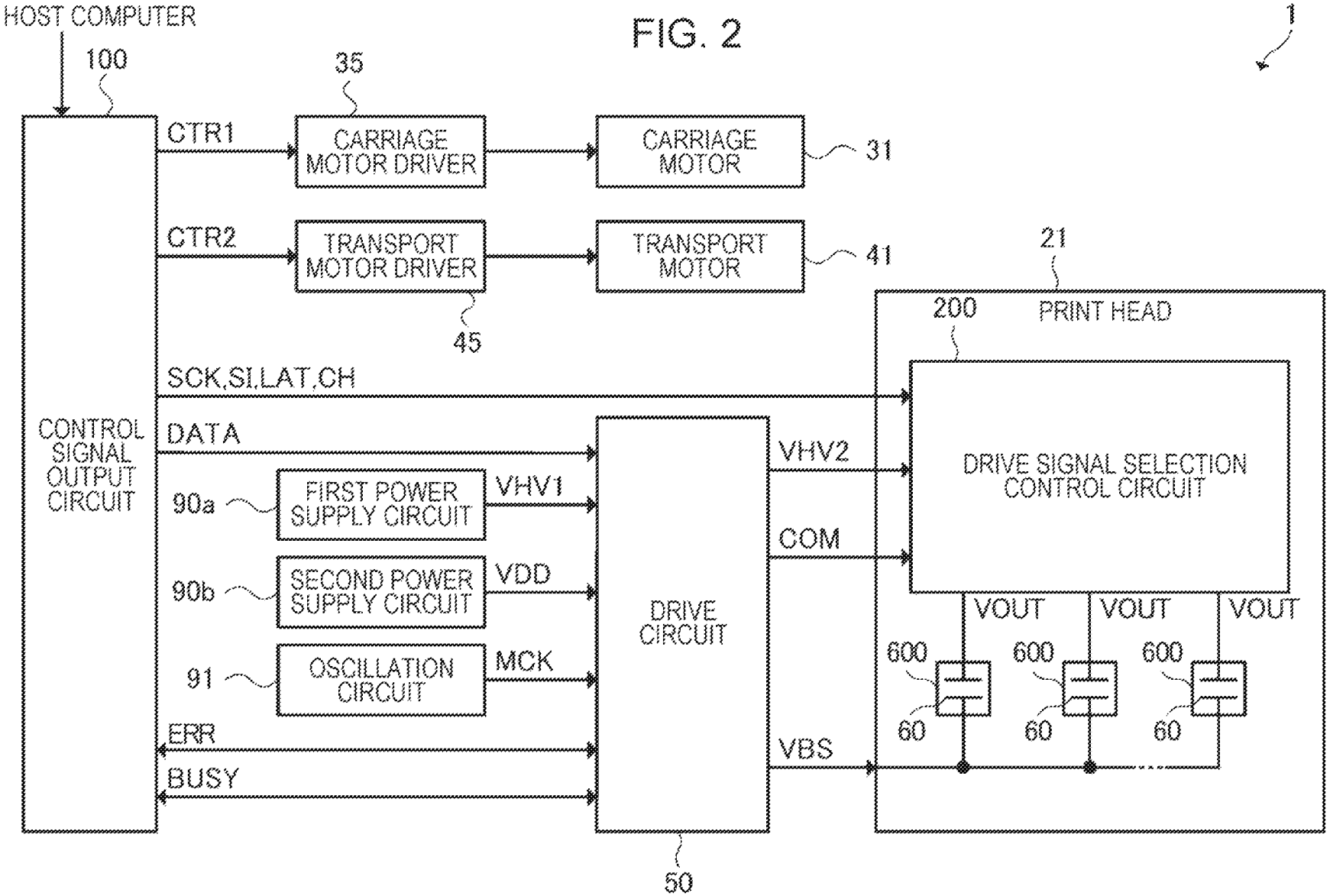
FIG. 2 is a diagram illustrating a functional configuration of the liquid ejecting apparatus.

FIG. 2 is a diagram illustrating a functional configuration of the liquid ejecting apparatus 1. As illustrated in FIG. 2, the liquid ejecting apparatus 1 includes a control signal output circuit 100, a carriage motor driver 35, the carriage motor 31, a transport motor driver 45, the transport motor 41, a drive circuit 50, a first power supply circuit 90*a*, and a second power supply circuit 90*b*, an oscillation circuit 91, and a print head 21.

The control signal output circuit 100 generates a plurality of control signals for controlling various configuration elements based on image data input from a host computer, and outputs the signals to the corresponding configuration elements. Specifically, the control signal output circuit 100 generates a control signal CTR1 and outputs the control signal CTR1 to the carriage motor driver 35. The carriage motor driver 35 drives the carriage motor 31 according to the input control signal CTR1. Thereby, movement of the carriage 24 in the direction Y is controlled. Further, the control signal output circuit 100 generates a control signal CTR2 and outputs the control signal CTR2 to the transport motor driver 45. The transport motor driver 45 drives the transport motor 41 according to the input control signal CTR2. Thereby, transport of the medium P in the direction X is controlled.

Further, the control signal output circuit 100 generates a drive data signal DATA for controlling an operation of the drive circuit 50, and outputs the drive data signal DATA to the drive circuit 50. Further, the control signal output circuit 100 generates a clock signal SCK, a printing data signal SI, a latch signal LAT, and a change signal CH that are used for controlling an operation of the print head 21, and outputs the generated signals to the print head 21.

The first power supply circuit 90*a* generates a voltage signal VHV1 having a voltage value of, for example, DC 42 V. The first power supply circuit 90*a* outputs the voltage signal VHV1 to the drive circuit 50. The second power supply circuit 90*b* generates a voltage signal VDD having a voltage value of, for example, DC 3.3 V. The second power supply circuit 90*b* outputs the voltage signal VDD to the drive circuit 50. The voltage signals VHV1 and VDD may be supplied to respective sections included in the liquid ejecting apparatus 1. Further, the first power supply circuit 90*a* and the second power supply circuit 90*b* may generate signals having voltage values different from the above-described voltage values of the voltage signal VHV1 and the voltage signal VDD.

The oscillation circuit 91 generates a clock signal MCK and outputs the clock signal MCK to the drive circuit 50. Here, the oscillation circuit 91 may be provided independently of the control signal output circuit 100 as illustrated in FIG. 2 or may be provided inside the control signal output circuit 100. Furthermore, the clock signal MCK output from the oscillation circuit 91 may be supplied to respective sections included in the liquid ejecting apparatus 1 in addition to the drive circuit 50.

The drive circuit 50 generates a drive signal COM by amplifying a signal having a waveform defined by the drive data signal DATA based on the voltage signal VHV1 and outputs the drive signal COM to the print head 21. Further, the drive circuit 50 generates a reference voltage signal VBS which is a reference potential of a piezoelectric element 60 included in the print head 21 and outputs the reference voltage signal VBS to the print head 21. Further, the drive circuit 50 propagates the voltage signal VHV1 input from the first power supply circuit 90*a* and outputs the voltage signal as the voltage signal VHV2. Here, a voltage value of the reference voltage signal VBS serving as the reference potential of the piezoelectric element 60 may be, for example, DC 6 V, DC 5.5 V, or the like, or may be a ground potential. A configuration and an operation of the drive circuit 50 will be described below in detail.

The print head 21 includes a drive signal selection control circuit 200 and a plurality of ejecting sections 600. Each of the ejecting sections 600 includes the piezoelectric element 60. The clock signal SCK, the printing data signal SI, the latch signal LAT, the change signal CH, the drive signal COM, and the voltage signal VHV2 are input to the drive signal selection control circuit 200. The drive signal selection control circuit 200 selects or deselects the drive signal COM based on the clock signal SCK, the printing data signal SI, the latch signal LAT, the change signal CH, and the voltage signal VHV2, thereby, generating a drive signal VOUT to output to the respective ejecting sections 600.

The drive signal VOUT is supplied to one end of the piezoelectric element 60 included in each of the plurality of ejecting sections 600. Further, the reference voltage signal VBS is supplied to the other end of the piezoelectric element 60. The piezoelectric element 60 is driven by a potential difference between the drive signal VOUT and the reference voltage signal VBS. Thereby, ink is ejected from the ejecting section 600. Here, the print head 21 that includes the piezoelectric element 60 and ejects ink by driving the piezoelectric element 60 is an example of a liquid ejecting head.

3. Configuration and Operation of Liquid Ejecting Head

Next, a configuration and an operation of the drive signal selection control circuit 200 will be described. In describing the configuration and operation of the drive signal selection control circuit 200, an example of a waveform of the drive signal COM input to the drive signal selection control circuit 200 will be first described with reference to FIG. 3. Thereafter, the configuration and operation of the drive signal selection control circuit 200 will be described with reference to FIGS. 4 to 7.

Figure 3:
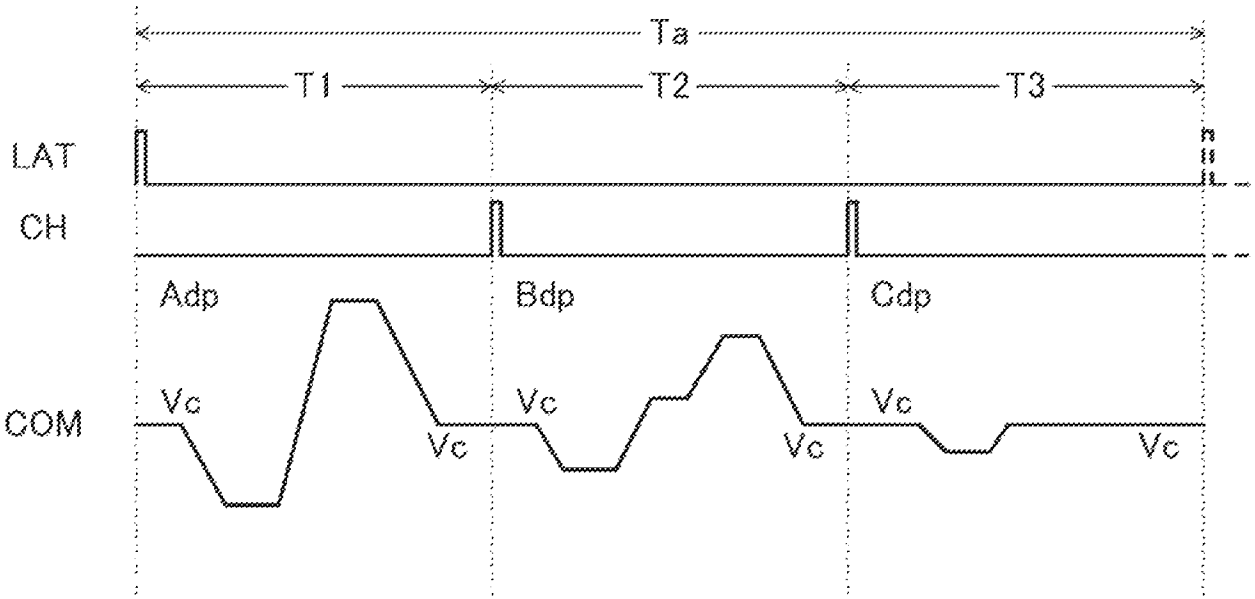
FIG. 3 is a diagram illustrating an example of a waveform of a drive signal COM.

FIG. 3 is a diagram illustrating an example of the waveform of the drive signal COM. FIG. 3 illustrates a period T1 from a rise of the latch signal LAT to a rise of the change signal CH, a period T2 from the period T1 to a next rise of the change signal CH, and a period T3 from the period T2 to a rise of the latch signal LAT. A period Ta configured by the periods T1, T2, and T3 corresponds to a printing period for forming new dots on the medium P. That is, the latch signal LAT defines a printing period in which a new dot is formed on the medium P, and the change signal CH defines a switch timing of a waveform included in the drive signal COM.

As illustrated in FIG. 3, the drive circuit 50 generates a trapezoidal waveform Adp in the period T1. When the trapezoidal waveform Adp is supplied to the piezoelectric element 60, a predetermined amount, specifically, a medium amount of ink is ejected from the corresponding ejecting section 600. Further, the drive circuit 50 generates a trapezoidal waveform Bdp in the period T2. When the trapezoidal waveform Bdp is supplied to the piezoelectric element 60, a small amount of ink less than the predetermined amount is ejected from the corresponding ejecting section 600. Further, the drive circuit 50 generates a trapezoidal waveform Cdp in the period T3. When the trapezoidal waveform Cdp is supplied to the piezoelectric element 60, the piezoelectric element 60 is driven to such an extent that ink is not ejected from the corresponding ejecting section 600. Thus, when the trapezoidal waveform Cdp is supplied to the piezoelectric element 60, no dot is formed on the medium P. The trapezoidal waveform Cdp performs micro-vibration of ink near a nozzle opening of the ejecting section 600 to prevent viscosity of the ink from increasing. In the following description, driving the piezoelectric element 60 to such an extent that the ink is not ejected from the ejecting section 600 in order to prevent the viscosity of the ink from increasing is referred to as "micro vibration" in some cases.

Here, a voltage value at a start timing and a voltage value at an end timing of each of the trapezoidal waveform Adp, the trapezoidal waveform Bdp, and the trapezoidal waveform Cdp are common as the voltage Vc. That is, the trapezoidal waveforms Adp, Bdp, and Cdp are waveforms whose voltage values start at the voltage Vc and end at the voltage Vc. As described above, the drive circuit 50 outputs the drive signal COM having a waveform in which the trapezoidal waveforms Adp, Bdp, and Cdp are continuous in the period Ta. The waveform of the drive signal COM illustrated in FIG. 3 is an example, and the present disclosure is not limited to this.

Figure 4:
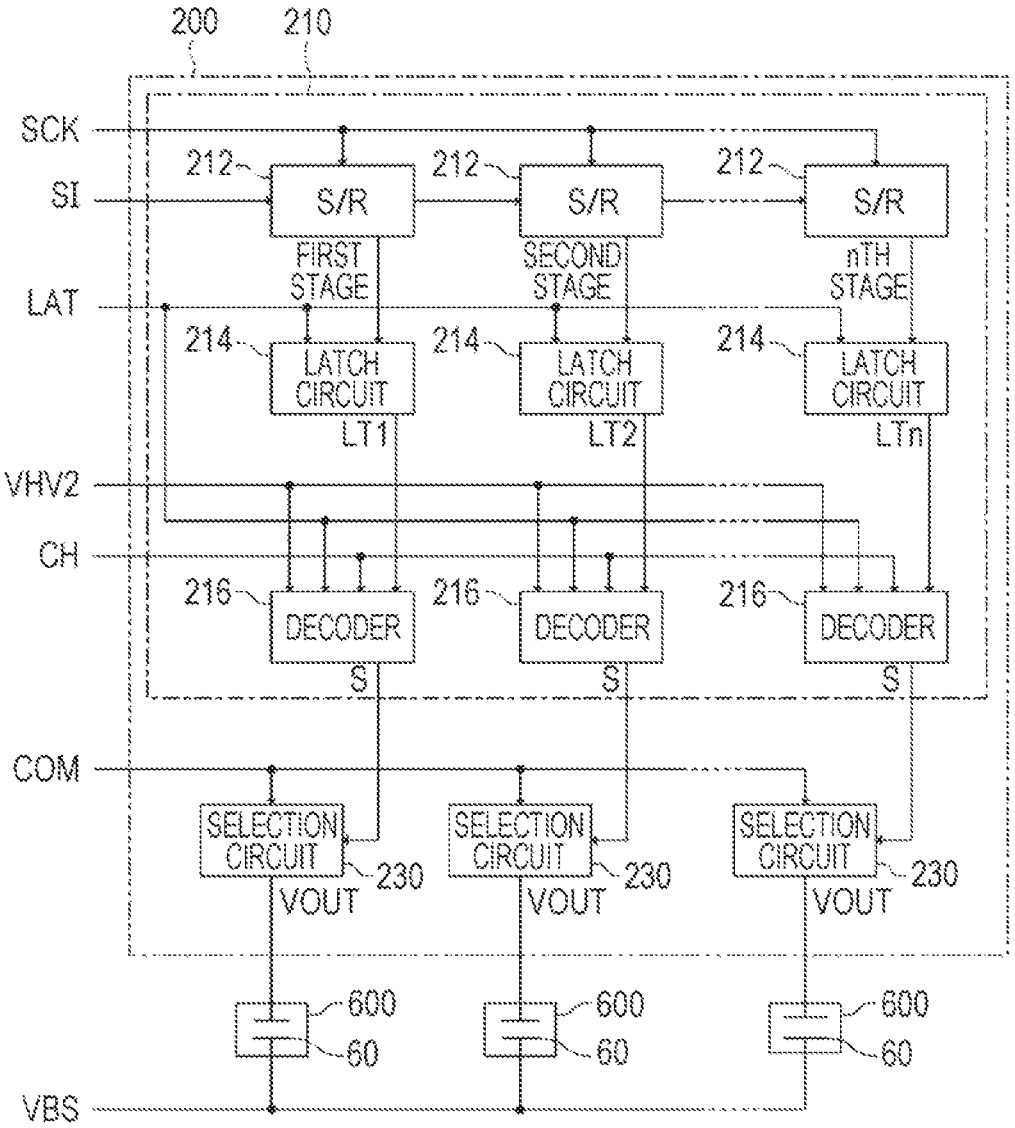
FIG. 4 is a diagram illustrating a functional configuration of a drive signal selection control circuit.

FIG. 4 is a diagram illustrating a functional configuration of the drive signal selection control circuit 200. The drive signal selection control circuit 200 switches whether or not to select the trapezoidal waveforms Adp, Bdp, and Cdp included in the drive signal COM in each of the periods T1, T2, and T3, thereby, generating and outputting the drive signal VOUT to be supplied to the piezoelectric element 60 in the period Ta.

As illustrated in FIG. 4, the drive signal selection control circuit 200 includes a selection control circuit 210 and a plurality of selection circuits 230. The selection control circuit 210 is supplied with the clock signal SCK, the printing data signal SI, the latch signal LAT, the change signal CH, and the voltage signal VHV2. In the selection control circuit 210, a set of a shift register 212 (S/R), a latch circuit 214, and a decoder 216 is provided to correspond to each of the ejecting sections 600. That is, the print head is provided with the same number of sets of the shift register 212, the latch circuit 214, and the decoder 216 as the n ejecting sections 600.

The shift register 212 temporarily holds the 2-bit printing data [SIH, SIL] included in the printing data signal SI for each corresponding ejecting section 600. Specifically, the shift registers 212 of multiple stages corresponding to the ejecting sections 600 are cascade-coupled to each other, and the printing data signal SI supplied in serial is sequentially transferred to the subsequent stage according to the clock signal SCK. As supply of the clock signal SCK is stopped, the 2-bit printing data [SIH, SIL] corresponding to the respective ejecting sections 600 are held in each of the shift registers 212. In FIG. 4, in order to distinguish between the shift registers 212, a first stage, a second stage, . . . , and an nth stage are described sequentially from an upstream to which the printing data signal SI is supplied.

Each of the n latch circuits 214 latches the printing data [SIH, SIL] held by the corresponding shift register 212 at a rising edge of the latch signal LAT. Each of the n decoders 216 decodes the 2-bit printing data [SIH, SIL] latched by the corresponding latch circuit 214, generates the selection signal S, and supplies the selection signal S to the selection circuit 230.

The selection circuits 230 are provided to correspond to the respective ejecting sections 600. That is, the number of selection circuits 230 included in one print head 21 is the same as the number of n ejecting sections 600 included in the print head 21. The selection circuit 230 controls supply of the drive signal COM to the piezoelectric element 60 based on the selection signal S supplied from the decoder 216.

Figures 5, 6:
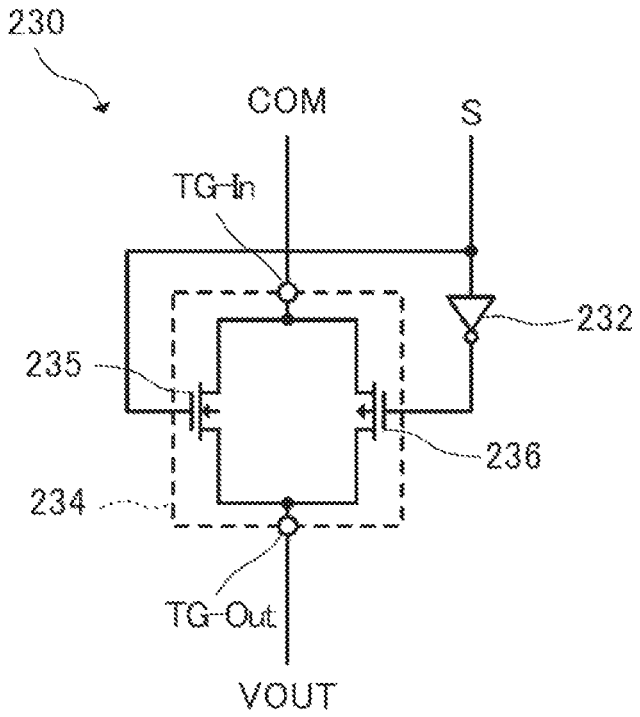
FIG. 5 is a diagram illustrating an electrical configuration of a selection circuit.
FIG. 6 is a diagram illustrating an example of decoding content in a decoder.

FIG. 5 is a diagram illustrating an electrical configuration of the selection circuit 230 corresponding to one ejecting section 600. As illustrated in FIG. 5, the selection circuit 230 includes an inverter 232 and a transfer gate 234. Further, the transfer gate 234 includes a transistor 235 that is an NMOS transistor and a transistor 236 that is a PMOS transistor.

The selection signal S is supplied from the decoder 216 to a gate terminal of the transistor 235. The selection signal S is logically inverted by the inverter 232 and is also supplied to a gate terminal of the transistor 236. A drain terminal of the transistor 235 and a source terminal of the transistor 236 are coupled to a terminal TG-In which is one end of the transfer gate 234. The drive signal COM is input to the terminal TG-In of the transfer gate 234. That is, the terminal TG-In of the transfer gate 234 is electrically coupled to the drive circuit 50. As the transistors 235 and 236 are turned on or turned off according to the selection signal S, the drive signal VOUT is output from a terminal TG-Out of the transfer gate 234 to which a source terminal of the transistor 235 and a drain terminal of the transistor 236 are commonly coupled. The terminal TG-Out of the transfer gate 234 from which the drive signal VOUT is output is electrically coupled to an electrode 611, which will be described below, of the piezoelectric element 60. Here, the selection circuit 230 or the transfer gate 234 included in the selection circuit 230 is an example of a switch circuit, the terminal TG-In is an example of one end of the switch circuit, and the terminal TG-Out is an example of the other end of the switch circuit.

Next, the decoding content of the decoder 216 will be described with reference to FIG. 6. FIG. 6 is a diagram illustrating an example of the decoding content in the decoder 216. The decoder 216 receives the 2-bit printing data [SIH, SIL], the latch signal LAT, and the change signal CH. For example, when the printing data [SIH, SIL] is [1, 0] defining a "medium dot", the decoder 216 outputs the selection signal S having H, L, and L levels in the periods T1, T2, and T3. Here, the logic level of the selection signal S is level-shifted to a high amplitude logic based on the voltage signal VHV2 by a level shifter (not illustrated).

Figure 7:
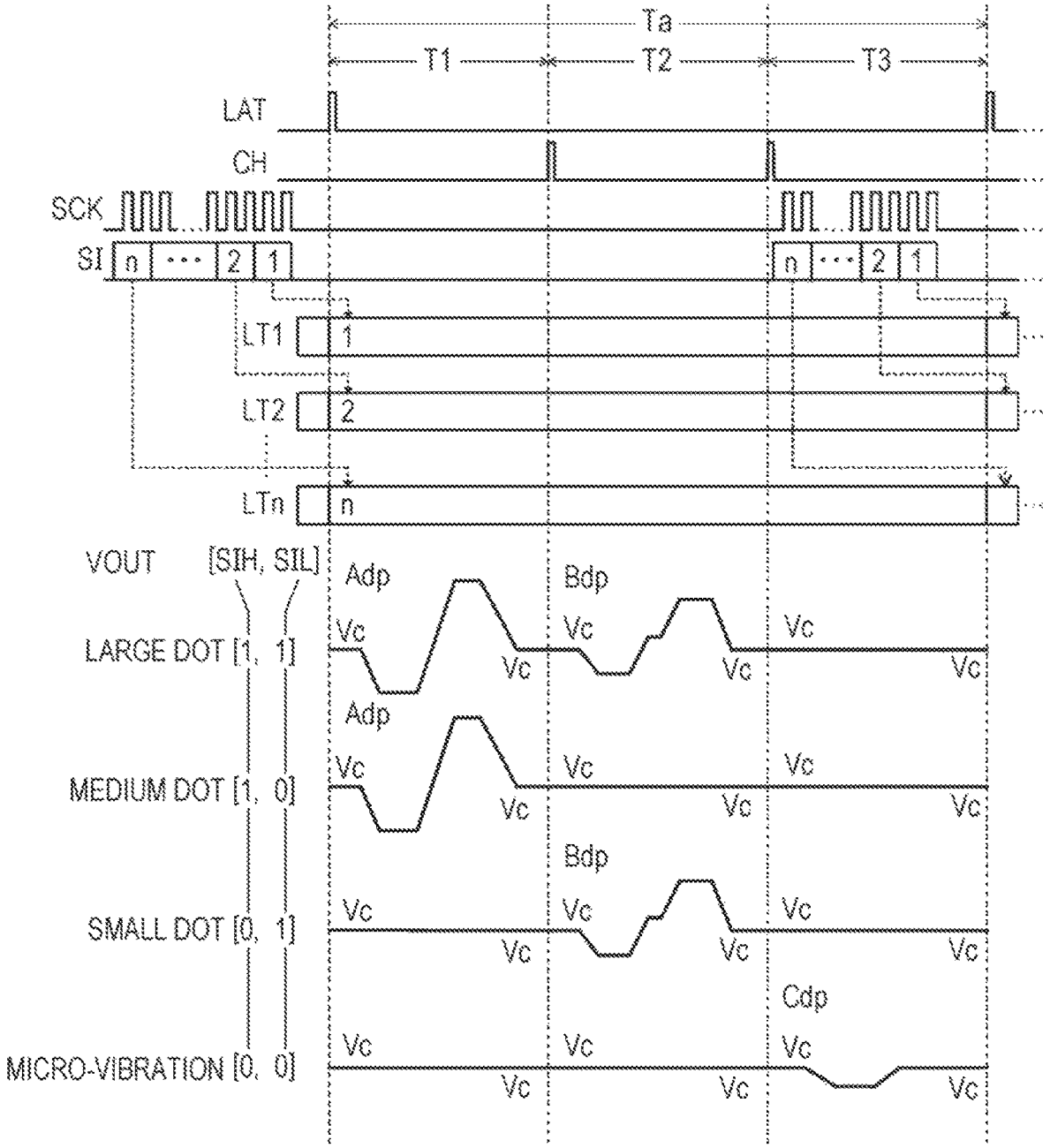
FIG. 7 is a diagram illustrating an operation of the drive signal selection control circuit.

FIG. 7 is a diagram illustrating an operation of the drive signal selection control circuit 200. As illustrated in FIG. 7, the printing data [SIH, SIL] included in the printing data signal SI are serially supplied to the drive signal selection control circuit 200 in synchronization with the clock signal SCK, and are sequentially transferred the shift register 212 corresponding to the ejecting section 600. When supply of the clock signal SCK is stopped, the printing data [SIH, SIL] corresponding to the ejecting section 600 is held in each of the shift registers 212. The printing data signal SI is supplied in the order corresponding to a last nth stage ejecting section 600, . . . , a second stage ejecting section 600, and a first stage ejecting section 600 in the shift register 212.

If the latch signal LAT rises, each of the latch circuits 214 simultaneously latches the printing data [SIH, SIL] held in the corresponding shift register 212. LT1, LT2, . . . , LTn illustrated in FIG. 7 indicate the printing data [SIH, SIL] latched by the latch circuits 214 corresponding to the first stage shift registers 212, the second stage shift registers 212, . . . , the nth stage shift registers 212.

The decoder 216 outputs the selection signal S having a logic level according to the content illustrated in FIG. 6 in each of the periods T1, T2, and T3 according to the dots size defined by the latched printing data [SIH, SIL].

When the printing data [SIH, SIL] is [1, 1], the selection circuit 230 selects the trapezoidal waveform Adp in the period T1, selects the trapezoidal waveform Bdp in the period T2, and does not select the trapezoidal waveform Cdp in the period T3, according to the selection signal S. As a result, the drive signal VOUT corresponding to the large dot illustrated in FIG. 7 is generated. Thus, the ejecting section 600 ejects a medium amount of ink and a small amount of ink. The large dot is formed on the medium P by combining ink on the medium P. Further, when the printing data [SIH, SIL] is [1, 0], the selection circuit 230 selects the trapezoidal waveform Adp in the period T1, does not select the trapezoidal waveform Bdp in the period T2, and does not select the trapezoidal waveform Cdp in the period T3, according to the selection signal S. As a result, the drive signal VOUT corresponding to a medium dot illustrated in FIG. 7 is generated. Thus, the ejecting section 600 ejects a medium amount of ink. Thus, the medium dot is formed on the medium P. Further, when the printing data [SIH, SIL] is [0, 1], the selection circuit 230 does not select the trapezoidal waveform Adp in the period T1, selects the trapezoidal waveform Bdp in the period T2, and does not select the trapezoidal waveform Cdp in the period T3, according to the selection signal S. As a result, the drive signal VOUT corresponding to a small dot illustrated in FIG. 7 is generated. Thus, a small amount of ink is ejected from the ejecting section 600. Thus, the small dot is formed on the medium P. When the printing data [SIH, SIL] is [0, 0], the selection circuit 230 does not select the trapezoidal waveform Adp in the period T1, does not select the trapezoidal waveform Bdp in the period T2, and select the trapezoidal waveform Cdp in the period T3, according to the selection signal S. As a result, the drive signal VOUT corresponding to the micro-vibration illustrated in FIG. 7 is generated. Thus, ink is not ejected from the ejecting section 600, and the micro-vibration is generated.

Figure 8:
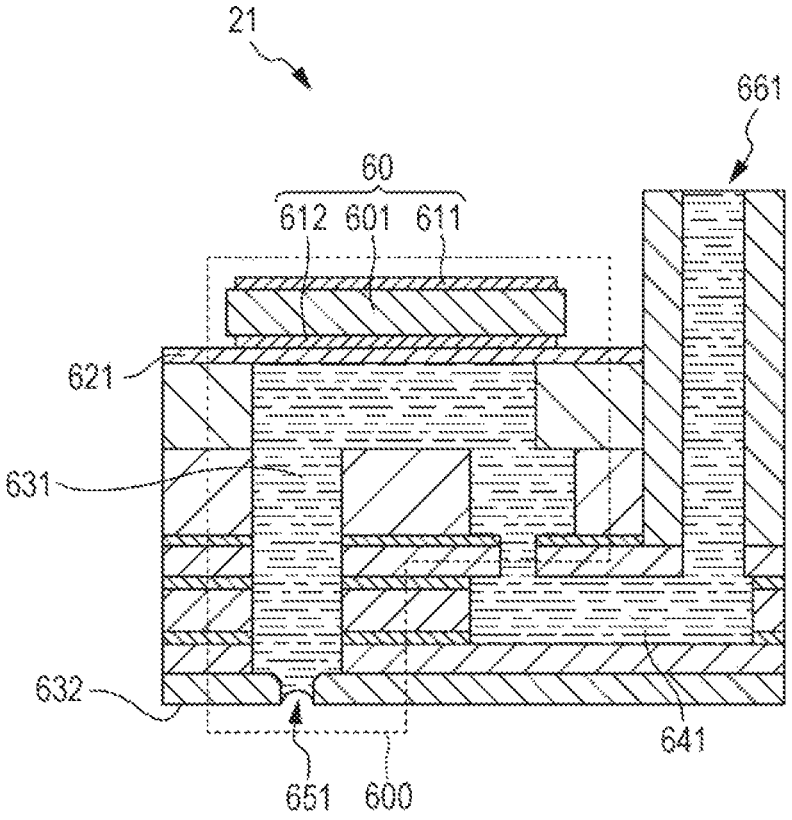
FIG. 8 is a diagram illustrating a schematic configuration of an ejecting section.

Here, a configuration of the ejecting section 600 including the piezoelectric element 60 will be described with reference to FIG. 8. FIG. 8 is a diagram illustrating a schematic configuration of the ejecting section 600 when the print head 21 is cut so as to include the ejecting section 600.

As illustrated in FIG. 8, the print head 21 includes the ejecting section 600 and a reservoir 641. Ink is introduced into the reservoir 641 from a supply hole 661. The reservoir 641 is provided for each color of ink.

The ejecting section 600 includes the piezoelectric element 60, a vibration plate 621, a cavity 631, and a nozzle 651. The vibration plate 621 is provided between the cavity 631 and the piezoelectric element 60. The vibration plate 621 is displaced by driving the piezoelectric element 60 provided on an upper surface. That is, the vibration plate 621 functions as a diaphragm that expands/contracts an internal volume of the cavity 631 by being displaced. The inside of the cavity 631 is filled with ink. Further, the cavity 631 functions as a pressure chamber in which the internal volume changes by driving the piezoelectric element 60. The nozzle 651 is an opening which is provided in a nozzle plate 632 and communicates with the cavity 631.

The piezoelectric element 60 has a structure in which a piezoelectric body 601 is interposed between a pair of electrodes 611 and 612. The drive signal VOUT is supplied to the electrode 611, and the reference voltage signal VBS is supplied to the electrode 612. The piezoelectric element 60 having the structure is driven according to a potential difference between the electrodes 611 and 612. As the piezoelectric element 60 is driven, the central portions of the electrodes 611 and 612 and the vibration plates 621 are displaced vertically with respect to both end portions. As the internal volume of the cavity 631 changes with the displacement of the vibration plate 621, the ink filled in the cavity 631 is ejected from the nozzle 651.

Here, the electrode 611 of the piezoelectric element 60 is an example of a first terminal, and the electrode 612 is an example of a second terminal. The piezoelectric body 601 included in the piezoelectric element 60 according to the present embodiment will be described as being subjected to polarization processing by applying a DC electric field by which the electrode 611 side has a high potential and the electrode 612 side has a low potential. Therefore, in the following description, a case in which a voltage signal by which the electrode 611 has a high potential and the electrode 612 has a low potential is supplied to the piezoelectric element 60, that is, a case in which an electric field in the same direction as the electric field subjected to the polarization processing of the piezoelectric body 601 is supplied to the piezoelectric element 60 is referred to as that a forward voltage is supplied to the piezoelectric element 60, and a case in which a voltage signal by which the electrode 611 has a low potential and the electrode 612 has a high potential is supplied to the piezoelectric element 60, that is, a case in which an electric field in an opposite direction to the electric field subjected to the polarization processing of the piezoelectric body 601 is supplied to the piezoelectric element 60 is referred to as that a reverse voltage is supplied to the piezoelectric element 60. A configuration of the piezoelectric element 60 is not limited to the illustrated structure, and may be, for example, a longitudinal vibration type.

4. Configuration and Operation of Drive Circuit

Figure 9:
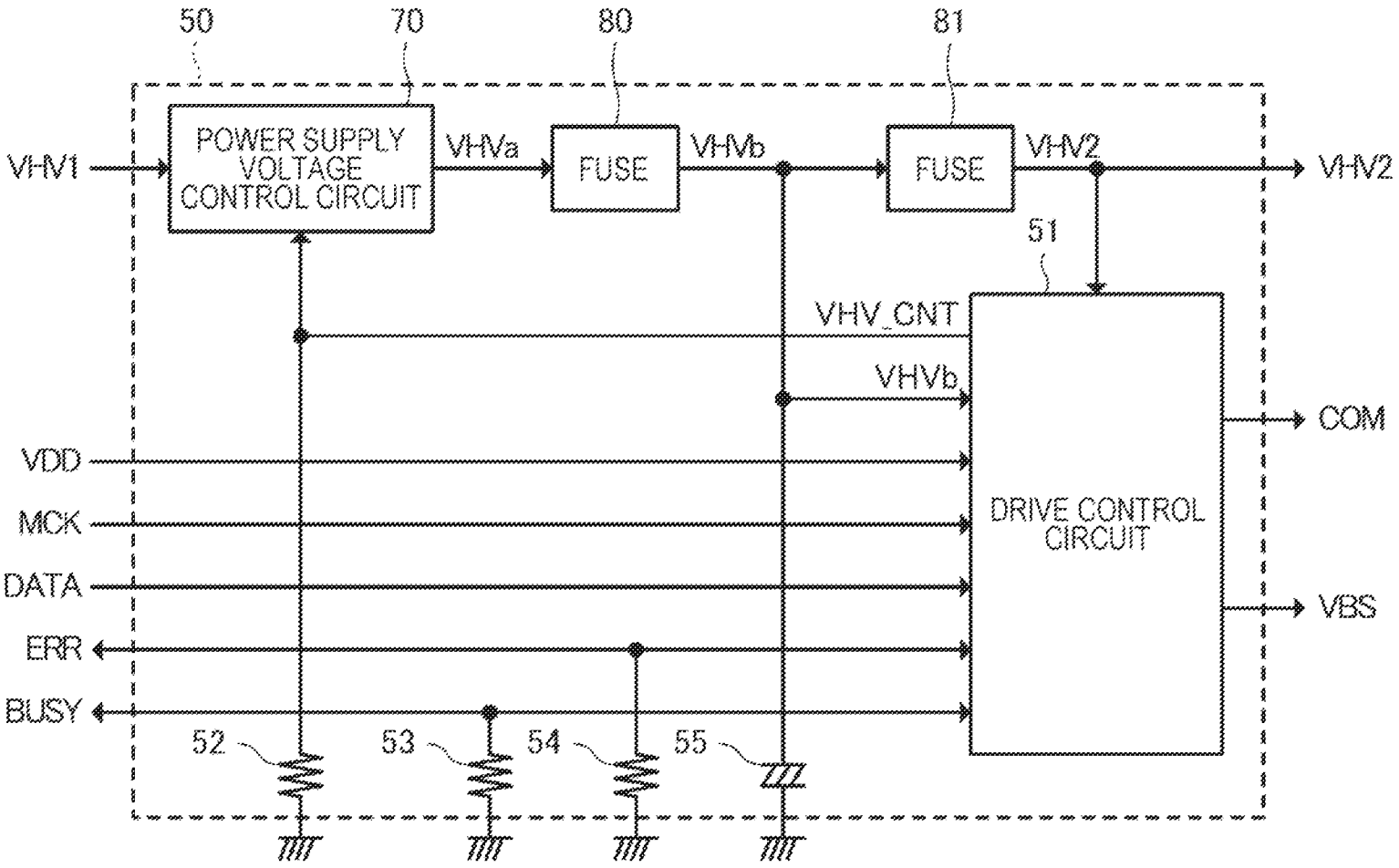
FIG. 9 is a diagram illustrating a functional configuration of a drive circuit.

Next, a configuration and an operation of the drive circuit 50 will be described. FIG. 9 is a diagram illustrating a functional configuration of the drive circuit 50. The drive circuit 50 includes a power supply voltage control circuit 70, fuses 80 and 81, a drive control circuit 51, and other circuit elements. The drive circuit 50 outputs the drive signal COM for driving a piezoelectric element included in the print head 21. In other words, the drive circuit 50 drives the piezoelectric element 60 included in the print head 21.

The power supply voltage control circuit 70 receives the voltage signal VHV1 from the first power supply circuit 90*a*. The power supply voltage control circuit 70 switches whether or not to output the input voltage signal VHV1 as a voltage signal VHVa. The voltage signal VHVa output from the power supply voltage control circuit 70 is input to the fuse 80. The fuse 80 outputs the input voltage signal VHVa to the fuse 81 as a voltage signal VHVb. The fuse 81 outputs the input voltage signal VHVb as the voltage signal VHV2. The voltage signal VHV2 is output from the drive circuit 50. The voltage signal VHV2 output from the drive circuit 50 is input to the drive signal selection control circuit 200 included in the print head 21.

Further, the voltage signal VHVb output from the fuse 80 is also input to the drive control circuit 51. Likewise, the voltage signal VHV2 output from the fuse 81 is also input to the drive control circuit 51. That is, the drive control circuit 51 receives the voltage signal VHVb output via the fuse 80 from the voltage signal VHVa output from the power supply voltage control circuit 70, and the voltage signal VHV2 output via the fuses 80 and 81 from the voltage signal VHVa output from the power supply voltage control circuit 70.

Further, in addition to the above-described voltage signals VHVa and VHVb, the voltage signal VDD output from the second power supply circuit 90*b*, the clock signal MCK output from the oscillation circuit 91, and the drive data signal DATA output from the control signal output circuit 100 are input to the drive control circuit 51. Furthermore, the drive control circuit 51 receives an error signal ERR and a state signal BUSY output from the control signal output circuit 100 and outputs the error signal ERR and the state signal BUSY to the control signal output circuit 100. That is, the error signal ERR and the state signal BUSY propagate in both directions between the drive control circuit 51 and the control signal output circuit 100.

Figure 10:
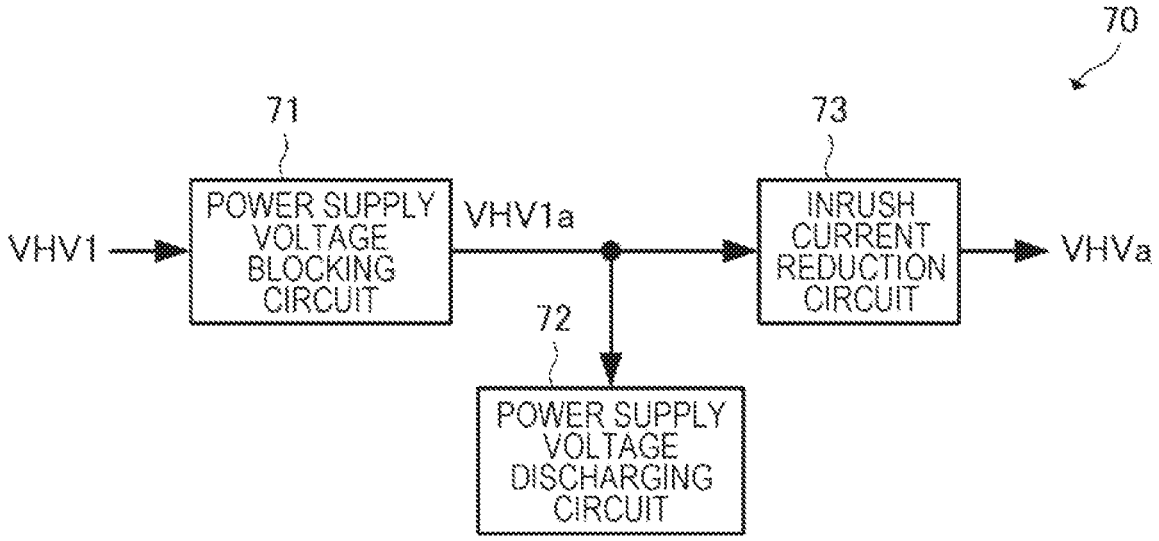
FIG. 10 is a diagram illustrating a functional configuration of a power supply voltage control circuit.

Here, configurations and operations of the drive control circuit 51 included in the drive circuit 50 and the power supply voltage control circuit 70 configured as described above will be described. FIG. 10 is a diagram illustrating a functional configuration of the power supply voltage control circuit 70. As illustrated in FIG. 10, the power supply voltage control circuit 70 includes a power supply voltage blocking circuit 71, a power supply voltage discharging circuit 72, and an inrush current reduction circuit 73. The voltage signal VHV1 input to the power supply voltage control circuit 70 is input to the power supply voltage blocking circuit 71. The power supply voltage blocking circuit 71 controls whether or not to supply the input voltage signal VHV1 to the inrush current reduction circuit 73 as a voltage signal VHV1*a*. The inrush current reduction circuit reduces an inrush current generated when supply of the voltage signal VHV1*a* is started, in a state in which the supply of the voltage signal VHV1*a* is blocked by the power supply voltage blocking circuit 71. In other words, the inrush current reduction circuit 73 reduces a possibility of generating an inrush current of a large current based on the voltage signal VHV1*a* output from the power supply voltage control circuit 70. The power supply voltage discharging circuit 72 is electrically coupled to the power supply voltage blocking circuit 71 and the inrush current reduction circuit 73 and is electrically coupled to a wire through which the voltage signal VHV1*a* propagates. The power supply voltage discharging circuit 72 controls release of electric charges stored in a path to which the voltage signal VHV1*a* output from the power supply voltage blocking circuit 71 is supplied.

Figure 11:
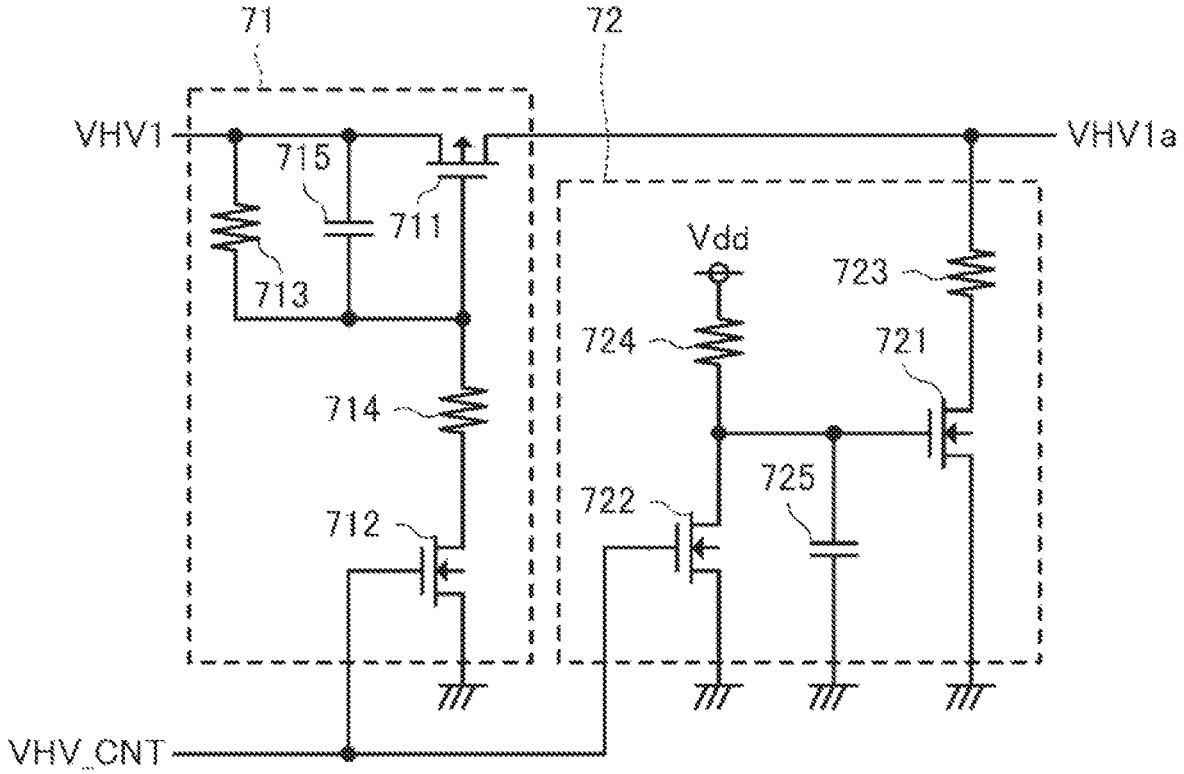
FIG. 11 illustrates an example of an electrical configuration of a power supply voltage blocking circuit and a power supply voltage discharging circuit.

Specific examples of configurations of the power supply voltage blocking circuit 71, the power supply voltage discharging circuit 72, and the inrush current reduction circuit 73 included in the power supply voltage control circuit 70 will be described with reference to FIGS. 11 and 12. FIG. 11 is a diagram illustrating an example of an electrical configuration of the power supply voltage blocking circuit 71 and the power supply voltage discharging circuit 72. As illustrated in FIG. 11, the power supply voltage blocking circuit 71 includes transistors 711 and 712, resistors 713 and 714, and a capacitor 715. Here, description will be made on the assumption that the transistor 711 is a PMOS transistor and the transistor 712 is an NMOS transistor.

The voltage signal VHV1 is input to a source terminal of the transistor 711. As conduction between a source terminal and a drain terminal of the transistor 711 is enabled, the voltage signal VHV1 is output from the drain terminal of the transistor 711 as the voltage signal VHV1*a*. In other words, the power supply voltage control circuit 70 switches conduction or non-conduction between the source terminal and the drain terminal of the transistor 711, thereby, switching whether or not to output the voltage signal VHV1 as the voltage signal VHV1*a*. A gate terminal of the transistor 711 is electrically coupled to one end of the resistor 713, one end of the resistor 714, and one end of the capacitor 715.

The voltage signal VHV1 is input to the other end of the resistor 713 and the other end of the capacitor 715. That is, the resistor 713 and the capacitor 715 are provided in parallel with the transistor 711 between the source terminal and the gate terminal of the transistor 711. The other end of the resistor 714 is electrically coupled to a drain terminal of the transistor 712. A ground potential is supplied to a source terminal of the transistor 712. A VHV control signal VHV_CNT is input to a gate terminal of the transistor 712 from the drive control circuit 51 which will be described below.

When an VHV control signal VHV_CNT of an H level is input to the power supply voltage blocking circuit 71 configured as described above, the transistor 712 is controlled to be conductive. As the transistor 712 is turned on, the transistor 711 is turned on. As a result, conduction between the source terminal and the drain terminal of the transistor 711 is enabled. Thus, the voltage signal VHV1 is output as the voltage signal VHV1*a*. Meanwhile, when the VHV control signal VHV_CNT of an L level is input to the power supply voltage blocking circuit 71, the transistor 712 is turned off. When the transistor 712 is turned off, the transistor 711 is turned off. As a result, conduction between the source terminal and the drain terminal of the transistor 711 is disabled. Thus, the voltage signal VHV1 is not output as the voltage signal VHV1*a*. As described above, the power supply voltage blocking circuit 71 including the transistor 711 switches whether or not to output the voltage signal VHV1 as the voltage signal VHV1*a* based on a logic level of the VHV control signal VHV_CNT.

The power supply voltage discharging circuit 72 includes transistors 721 and 722, resistors 723 and 724, and a capacitor 725. Here, description will be made on the assumption that both the transistors 721 and 722 are NMOS transistors.

One end of the resistor 723 is electrically coupled to a wire through which the voltage signal VHV1*a* is propagated, and the other end of the resistor 723 is electrically coupled to a drain terminal of the transistor 721. The ground potential is supplied to a source terminal of the transistor 721. A gate terminal of the transistor 721 is electrically coupled to one end of the resistor 724, one end of the capacitor 725, and a drain terminal of the transistor 722. The other end of the resistor 724 is supplied to the voltage signal VDD. The ground potential is supplied to the other end of the capacitor 725 and a source terminal of the transistor 722. The VHV control signal VHV_CNT is input to a gate terminal of the transistor 722.

The power supply voltage discharging circuit 72 configured as described above is electrically coupled to a wire that electrically couples the power supply voltage blocking circuit 71 to the inrush current reduction circuit 73. The power supply voltage discharging circuit 72 controls release of stored electric charges based on the voltage signal VHV1*a* according to a logic level of the VHV control signal VHV_CNT. Specifically, when the VHV control signal VHV_CNT of an H level is input to the power supply voltage discharging circuit 72, the transistor 722 is turned on. As the transistor 722 is turned on, the transistor 721 is turned off. Thus, a path through which the voltage signal VHV1*a* is propagated and a path through which the ground potential is supplied are controlled to be non-conductive by the transistor 721. As a result, the power supply voltage discharging circuit 72 does not release electric charges based on the voltage signal VHV1*a*.

Meanwhile, when the VHV control signal VHV_CNT of an L level is input to the power supply voltage discharging circuit 72, the transistor 722 is turned off. As the transistor 722 is turned off, the voltage signal VDD is supplied to the gate terminal of the transistor 721. Thus, the transistor 721 is turned on. Thereby, the path through which the voltage signal VHV1*a* is propagated and the path through which the ground potential is supplied are electrically coupled to each other via the resistor 723. Thereby, the power supply voltage discharging circuit 72 releases the electric charge stored in the path through which the voltage signal VHV1*a* is propagated.

As described above, the power supply voltage blocking circuit 71 and the power supply voltage discharging circuit 72 switches whether to output the voltage signal VHV1 to the inrush current reduction circuit 73 as the voltage signal VHV1*a* based on the logic level of the VHV control signal VHV_CNT or to release the electric charges stored in the path through which the voltage signal VHV1*a* is propagated.

Figure 12:
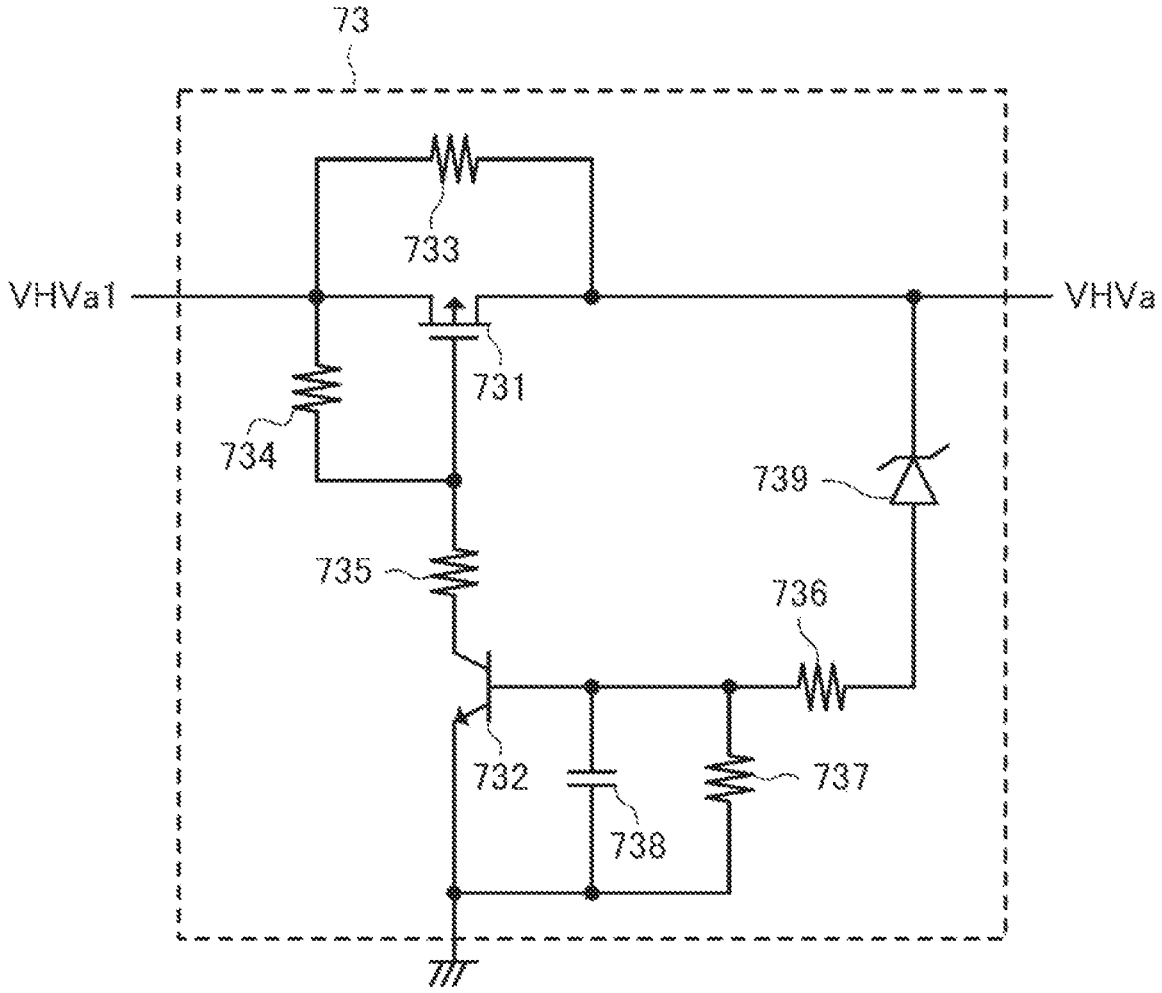
FIG. 12 is a diagram illustrating an example of an electrical configuration of an inrush current reduction circuit.

FIG. 12 is a diagram illustrating an example of an electrical configuration of the inrush current reduction circuit 73. As illustrated in FIG. 12, the inrush current reduction circuit 73 includes transistors 731 and 732, resistors 733, 734, 735, 736, and 737, a capacitor 738, and a constant voltage diode 739. Here, description will be made on the assumption that the transistor 731 is a PMOS transistor and the transistor 732 is an N-type bipolar transistor.

The voltage signal VHV1*a* is input to a source terminal of the transistor 731. As a drain terminal and the source terminal of the transistor 731 are controlled to be conductive, the voltage signal VHV1*a* is output from the drain terminal of the transistor 731 as the voltage signal VHVa. A gate terminal of the transistor 731 is electrically coupled to one end of the resistor 734 and one end of the resistor 735. The voltage signal VHV1*a* is input to the other end of the resistor 734. That is, the resistor 734 is provided in parallel with the transistor 731 between the source terminal and the gate terminal of the transistor 731. The resistor 733 has one end electrically coupled to the source terminal of the transistor 731 and the other end electrically coupled to the drain terminal of the transistor 731.

The other end of the resistor 735 is electrically coupled to a collector terminal of the transistor 732. A ground potential is supplied to an emitter terminal of the transistor 732. A base terminal of the transistor 732 is electrically coupled to one end of the resistor 736, one end of the resistor 737, and one end of the capacitor 738. The ground potential is supplied to the other end of the resistor 737 and the other end of the capacitor 738. That is, the resistor 737 and the capacitor 738 are provided between the base terminal and the emitter terminal of the transistor 732 in parallel with the transistor 732.

The other end of the resistor 736 is electrically coupled to an anode terminal of the constant voltage diode 739. The voltage signal VHVa is input to a cathode terminal of the constant voltage diode 739.

The inrush current reduction circuit 73 configured as described above does not receive the voltage signal VHV1*a*, when supply of the voltage signal VHV1*a* is blocked by the power supply voltage blocking circuit 71. Thus, the inrush current reduction circuit 73 does not output the voltage signal VHVa. Since the voltage signal VHVa is not output, a potential of the anode terminal of the constant voltage diode 739 becomes the ground potential supplied through the resistor 737. Thus, the transistor 732 is turned off, and the transistor 731 is also turned off.

In a state in which supply of the voltage signal VHV1*a* is blocked by the power supply voltage blocking circuit 71, when the supply of the voltage signal VHV1*a* is started, the voltage signal VHV1*a* is input to the inrush current reduction circuit 73. In this case, the transistor 731 is turned off, and thus, the voltage signal VHV1*a* is input to the drain terminal of the transistor 731 via the resistor 733 as the voltage signal VHVa. At this time, a current generated by the voltage signal VHV1*a* and the voltage signal VHVa is limited by the resistor 733. Thus, a possibility of generating an inrush current of a large current is reduced.

As a predetermined period elapses after input of the voltage signal VHV1*a* to the inrush current reduction circuit 73 starts, a voltage value of the voltage signal VHVa increases. Specifically, the voltage signal VHV1*a* input to the inrush current reduction circuit 73 is input to the capacitor 55 illustrated in FIG. 9 via the resistor 733 and the fuse 80. Thereby, electric charges are stored in the capacitor 55. As the electric charges are stored in the capacitor 55, the voltage value of the voltage signal VHVa increases. When the voltage value of the voltage signal VHVa is greater than or equal to a predetermined value defined by the constant voltage diode 739, a voltage value of the anode terminal of the constant voltage diode 739 increases. When the voltage value of the anode terminal of the constant voltage diode 739 exceeds a threshold voltage of the transistor 732, the transistor 732 is turned on. If the transistor 732 is turned on, the transistor 731 is turned on. Thereby, conduction between the drain terminal and the source terminal of the transistor 731 is enabled, and the voltage signal VHV1*a* is output from the power supply voltage control circuit 70 via the transistor 731 as the voltage signal VHVa.

In the inrush current reduction circuit 73 configured as described above, in a state in which the supply of the voltage signal VHV1*a* is blocked, immediately after the supply of the voltage signal VHV1*a* is started, the voltage signal VHV1*a* is propagated to the drain terminal of the transistor 731 via the resistor 733. Thereby, it is possible to reduce a possibility that an inrush current of a large current is generated. Further, as a voltage value of voltage signal VHVa is greater than or equal to a predetermined value defined by the constant voltage diode 739, the transistor 731 is turned on. Thereby, it is possible to reduce a power loss caused by the resistor 733.

Returning to FIG. 9, the voltage signal VHVa output from the power supply voltage control circuit 70 is input to the drive control circuit 51 as the voltage signal VHVb via the fuse 80 and is also input to the drive control circuit 51 via the fuses 80 and 81 as the voltage signal VHV2.

Figure 13:
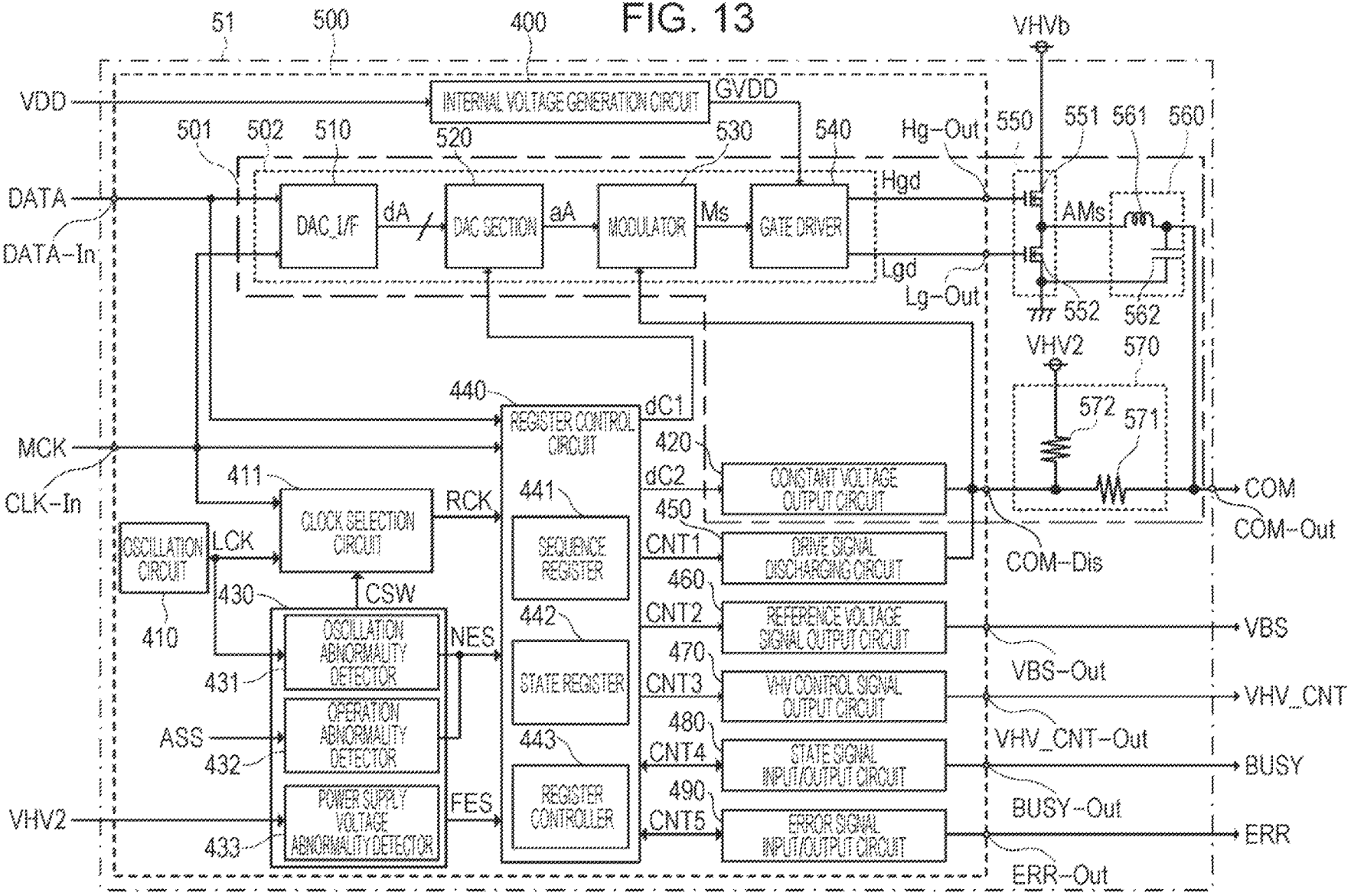
FIG. 13 is a diagram illustrating a functional configuration of a drive control circuit.

Next, a configuration and an operation of the drive control circuit 51 will be described with reference to FIG. 13. FIG. 13 is a diagram illustrating a functional configuration of the drive control circuit 51. The drive control circuit 51 includes an integrated circuit 500, an amplification circuit 550, a demodulation circuit 560, and a feedback circuit 570.

The integrated circuit 500 includes an amplification control signal generation circuit 502, an internal voltage generation circuit 400, an oscillation circuit 410, a clock selection circuit 411, an abnormality detection circuit 430, a register control circuit 440, a constant voltage output circuit 420, a drive signal discharging circuit 450, a reference voltage signal output circuit 460, a VHV control signal output circuit 470, a state signal input/output circuit 480, and an error signal input/output circuit 490.

The voltage signal VDD is supplied to the internal voltage generation circuit 400. The internal voltage generation circuit 400 generates a voltage signal GVDD having, for example, a voltage value of DC 7.5 V by boosting or dropping a voltage of the input voltage signal VDD. The voltage signal GVDD is input to various configurations of the integrated circuit 500 including a gate driver 540 which will be described below.

The amplification control signal generation circuit 502 generates amplification control signals Hgd and Lgd based on a data signal that defines a waveform of the drive signal COM included in the drive data signal DATA input from a terminal DATA-In. The amplification control signal generation circuit 502 includes a DAC interface (DAC_I/F: Digital to Analog Converter Interface) 510, a DAC section 520, a modulator 530, and the gate driver 540.

The drive data signal DATA supplied from the terminal DATA-In and the clock signal MCK supplied from the terminal MCK-In are input to the DAC interface 510. The DAC interface 510 integrates the drive data signal DATA based on the clock signal MCK, and generates, for example, 10-bit drive data dA that defines a waveform of the drive signal COM. The drive data dA is input to the DAC section 520. The DAC section 520 converts the drive data dA which is input into an original drive signal aA of an analog signal. The original drive signal aA is a target signal before the drive signal COM is amplified. The modulator 530 receives the original drive signal aA. The modulator 530 outputs a modulation signal Ms obtained by performing a pulse width modulation of the original drive signal aA. In other words, the modulator 530 modulates the original drive signal aA and outputs the modulation signal Ms. The gate driver 540 receives the voltage signals VHVb and GVDD, and the modulation signal Ms. The gate driver 540 amplifies the input modulation signal Ms based on the voltage signal GVDD and generates the amplification control signal Hgd that is level-shifted to a high amplitude logic based on the voltage signal VHVb, and the amplification control signal Lgd obtained by inverting a logic level of the input modulation signal Ms and amplifying the modulation signal MS based on the voltage signal GVDD. Thus, the amplification control signal Hgd and the amplification control signal Lgd are exclusively at an H level.

Here, that the amplification control signal Hgd and the amplification control signal Lgd are exclusively at an H level includes that the amplification control signal Hgd and the amplification control signal Lgd are not at the H level at the same time. That is, the gate driver 540 may include a timing control circuit that controls timing at which the amplification control signal Hgd and the amplification control signal Lgd go to the H level such that the amplification control signal Hgd and the amplification control signal Lgd do not go to the H level at the same time.

The amplification control signal Hgd is output from the integrated circuit 500 via a terminal Hg-Out and is input to the amplification circuit 550. Likewise, the amplification control signal Lgd is output from the integrated circuit 500 via a terminal Lg-Out and is input to the amplification circuit 550. Here, the amplification control signal Hgd is obtained by level-shifting a logic level of the modulation signal Ms, and the amplification control signal Lgd is obtained by inverting the logic level of the modulation signal Ms. Thus, the amplification control signal Hgd and the amplification control signal Lgd also correspond to a signal modulated by the modulator 530 in a broad sense. Here, the modulator 530 is an example of a modulation circuit, and a configuration including the modulator 530 and the gate driver 540 that level-shifts the modulation signal Ms generated by the modulator 530 is also an example of the modulation circuit in a broad sense. The modulation signal Ms generated by modulating the original drive signal aA, and the amplification control signals Hgd and Lgd are examples of modulation signals.

The amplification circuit 550 outputs an amplification modulation signal AMs by operating based on the amplification control signals Hgd and Lgd. In other words, the amplification circuit 550 amplifies the modulation signal Ms and outputs the amplification modulation signal AMs. The amplification circuit 550 includes transistors 551 and 552. Each of the transistors 551 and 552 is, for example, an N-channel field effect transistor (FET).

The voltage signal VHVb is supplied to a drain terminal of the transistor 551. The amplification control signal Hgd is supplied to a gate terminal of the transistor 551 via the terminal Hg-Out. A source terminal of the transistor 551 is electrically coupled to a drain terminal of the transistor 552. The amplification control signal Lgd is supplied to a gate terminal of the transistor 552 via the terminal Lg-Out. A ground potential is supplied to a source terminal of the transistor 552. The transistor 551 coupled as described above operates according to the amplification control signal Hgd, and the transistor 552 operates according to the amplification control signal Lgd that is exclusively at an H level with respect to the amplification control signal Hgd. That is, the transistors 551 and 552 are exclusively turned on. Thereby, the amplification modulation signal AMs obtained by amplifying the modulation signal Ms based on the voltage signal VHVb is generated at a coupling point between the source terminal of the transistor 551 and the drain terminal of the transistor 552.

The amplification modulation signal AMs generated by the amplification circuit 550 is input to a demodulation circuit 560. The demodulation circuit 560 includes a coil 561 and a capacitor 562. One end of the coil 561 is electrically coupled to the source terminal of the transistor 551 and the drain terminal of the transistor 552. The other end of the coil 561 is electrically coupled to one end of the capacitor 562. The other end of the capacitor 562 receives the ground potential. That is, the coil 561 and the capacitor 562 configure a low-pass filter. As the amplification modulation signal AMs is supplied to the demodulation circuit 560, the amplification modulation signal AMs is demodulated, and the drive signal COM is generated. That is, the demodulation circuit 560 demodulates the amplification modulation signal AMs and outputs the drive signal COM from the terminal COM-Out.

Further, the drive signal COM generated by the demodulation circuit 560 is fed back to the modulator 530 via the feedback circuit 570. In other words, the feedback circuit 570 feeds back the drive signal COM to the modulator 530. The feedback circuit 570 includes resistors 571 and 572. One end of the resistor 571 is electrically coupled to the other end of the coil 561, and the other end of the resistor 571 is electrically coupled to one end of the resistor 572. The other end of the resistor 572 receives the voltage signal VHV2. The other end of the resistor 571 and one end of the resistor 572 are electrically coupled to the modulator 530 via a terminal COM-Dis. That is, the drive signal COM is pulled up by the voltage signal VHV2 via the feedback circuit 570 and is fed back to the modulator 530.

As described above, the amplification control signal generation circuit 502, the amplification circuit 550, the demodulation circuit 560, and the feedback circuit 570 included in the integrated circuit 500 generate the drive signal COM for driving the piezoelectric element 60 based on the drive data signal DATA. The generated drive signal COM is supplied to the electrode 611 of the piezoelectric element 60 via the terminal COM-Out and the selection circuit 230. That is, the terminal COM-Out is electrically coupled to the terminal TG-In of the selection circuit 230. The amplification control signal generation circuit 502, the amplification circuit 550, the demodulation circuit 560, and the feedback circuit 570 configured as described above can output signals including the trapezoidal waveforms Adp, Bdp, and Cdp illustrated in FIG. 3 to drive the piezoelectric element 60 based on the drive data signal DATA and can also output a signal having a constant voltage value as the drive signal COM. That is, the demodulation circuit 560 can output the drive signal COM having a constant voltage value and the drive signal COM having a variable voltage value for driving the piezoelectric element 60. Here, the drive signal COM is an example of a drive signal, and the drive signal VOUT generated by selecting or deselecting the waveform of the drive signal COM is also an example of a drive signal. The terminal COM-Out from which the drive signal COM is output is an example of an output terminal.

The oscillation circuit 410 generates and outputs a clock signal LCK that defines an operation timing of the integrated circuit 500. The clock signal LCK is input to the clock selection circuit 411 and the abnormality detection circuit 430.

The clock signals MCK and LCK and a clock selection signal CSW are input to the clock selection circuit 411. The clock selection circuit 411 switches whether to output the clock signal MCK as a clock signal RCK to a register control circuit 440 based on a logic level of the clock selection signal CSW or to output the clock signal LCK to the register control circuit 440 as the clock signal RCK. In the present embodiment, description will be made on the assumption that the clock selection circuit 411 outputs the clock signal MCK to the register control circuit 440 as the clock signal RCK when the clock selection signal CSW is at an H level and outputs the clock signal LCK to the register control circuit 440 as the clock signal RCK when the clock selection signal CSW is at an L level.

The abnormality detection circuit 430 includes an oscillation abnormality detector 431, an operation abnormality detector 432, and a power supply voltage abnormality detector 433.

The clock signal LCK output from the oscillation circuit 410 is input to the oscillation abnormality detector 431. The oscillation abnormality detector 431 detects whether or not the input clock signal LCK is normal, and outputs the clock selection signal CSW and an error signal NES of a logic level based on the detection result. For example, the oscillation abnormality detector 431 detects at least one of a frequency and a voltage value of the clock signal LCK. When it is detected that at least one of the frequency and the voltage value of the clock signal LCK is abnormal, the oscillation abnormality detector 431 outputs the clock selection signal CSW and the error signal NES indicating that the clock signal is abnormal to each of the clock selection circuit 411 and the register control circuits 440. Further, when both the frequency and the voltage value of the clock signal LCK are normal, the oscillation abnormality detector 431 outputs the clock selection signal CSW and the error signal NES indicating that the clock signal LCK is normal to the clock selection circuit 411 and the register control circuit 440.

An operation state signal ASS indicating operation states of various configuration elements of the drive control circuit 51 is input to the operation abnormality detector 432. The operation abnormality detector 432 detects whether or not various configuration elements of the drive control circuit 51 normally operate based on the input operation state signal ASS. In the present embodiment, when any of the various configurations of the drive control circuit 51 is abnormal, the operation state signal ASS indicating the abnormality is input to the operation abnormality detector 432. When the operation state signal ASS indicating the abnormality is input to the operation abnormality detector 432, the operation abnormality detector 432 outputs the error signal NES indicating the abnormality to the register control circuit 440.

The voltage signal VHV2 output from the drive circuit 50 and supplied to the print head 21 is input to the power supply voltage abnormality detector 433. The power supply voltage abnormality detector 433 detects a voltage value of the voltage signal VHV2. The power supply voltage abnormality detector 433 detects whether or not the voltage value of the voltage signal VHV2 supplied to the print head 21 is normal based on the voltage value of the voltage signal VHV2. When it is determined that the voltage value of the voltage signal VHV2 supplied to the print head 21 is abnormal, the power supply voltage abnormality detector 433 outputs the error signal FES indicating the abnormality to the register control circuit 440.

The register control circuit 440 includes a sequence register 441, a state register 442, and a register controller 443. The sequence register 441 and the state register 442 hold operation information and the like input as the drive data signal DATA in synchronization with the clock signal MCK. The register controller 443 generates control signals CNT1 to CNT5 based on the information held in the sequence register 441 and the state register 442 in synchronization with the clock signal RCK, and outputs the generated signals to the corresponding configurations.

The control signal CNT1 is input to the drive signal discharging circuit 450. The drive signal discharging circuit 450 controls whether or not to release the stored electric charges based on the drive signal COM output from the demodulation circuit 560 via the feedback circuit 570. The drive signal discharging circuit 450 is electrically coupled, via the feedback circuit 570, to a propagation path through which the drive signal COM output from the demodulation circuit 560 is propagated.

Figure 14:
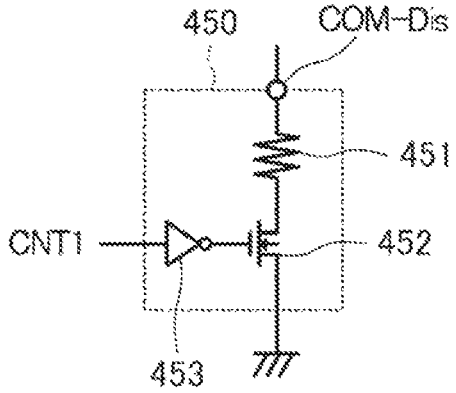
FIG. 14 is a diagram illustrating an example of an electrical configuration of a drive signal discharging circuit.

FIG. 14 is a diagram illustrating an example of an electrical configuration of the drive signal discharging circuit 450. The drive signal discharging circuit 450 includes a resistor 451, a transistor 452, and an inverter 453. Description will be made on the assumption that the transistor 452 is an NMOS transistor.

One end of the resistor 451 is electrically coupled to the terminal COM-Dis. The other end of the resistor 451 is electrically coupled to a drain terminal of the transistor 452. A ground potential is supplied to a source terminal of the transistor 452. The control signal CNT1 is input to a gate terminal of the transistor 452 via the inverter 453. When the control signal CNT1 of an H level is input to the drive signal discharging circuit 450 configured as described above, the transistor 452 is turned off. Thus, the drive signal discharging circuit 450 does not release the electric charges stored in a propagation path through which the drive signal COM is propagated. Meanwhile, when the control signal CNT1 of an L level is input to the drive signal discharging circuit 450, the transistor 452 is turned on. Thus, in the drive signal discharging circuit 450, the electric charges stored in the propagation path through which the drive signal COM is propagated via the feedback circuit 570 is released via the resistor 451 and the transistor 452. As described above, the drive signal discharging circuit 450 controls whether or not the drive signal COM releases the electric charges which are stored in the propagation path and are supplied to the print head 21, based on the control signal CNT1.

The control signal CNT2 is input to the reference voltage signal output circuit 460. The reference voltage signal output circuit 460 outputs the reference voltage signal VBS supplied to the electrode 612 of the piezoelectric element 60. That is, the reference voltage signal output circuit 460 is electrically coupled to the electrode 612 of the piezoelectric element 60 and outputs the reference voltage signal VBS in which a voltage value supplied to the electrode 612 of the piezoelectric element 60 is constant at the voltage Vbs. Here, the reference voltage signal output circuit 460 is an example of a reference voltage signal output circuit, and the reference voltage signal VBS output from the reference voltage signal output circuit 460 is an example of a second constant voltage signal. The voltage Vbs, which is the voltage value of the reference voltage signal VBS, is an example of the second voltage value.

Figure 15:
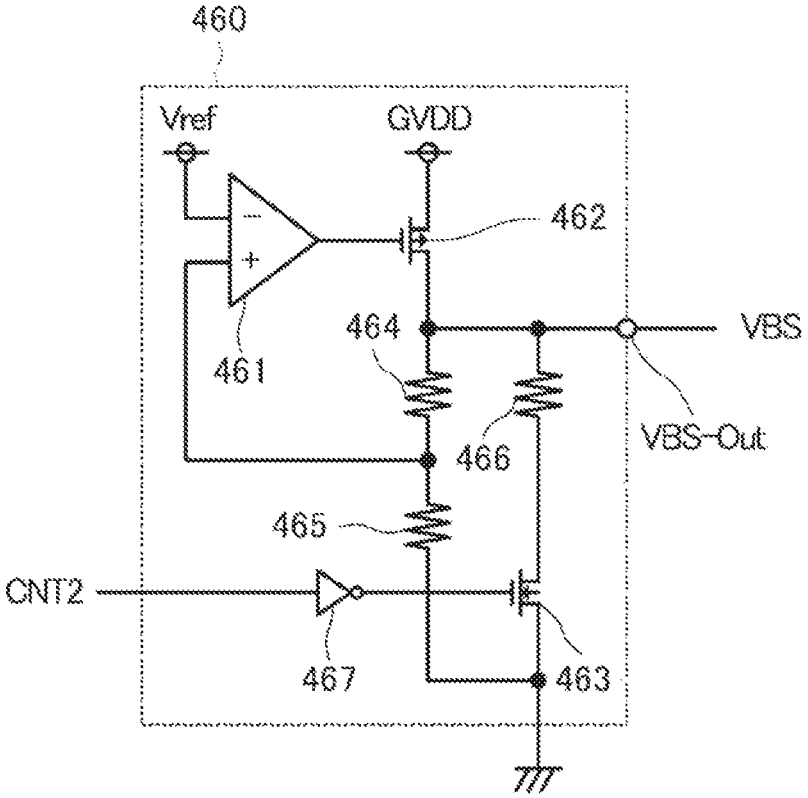
FIG. 15 is a diagram illustrating an example of an electrical configuration of a reference voltage signal output circuit.

FIG. 15 is a diagram illustrating an example of an electrical configuration of the reference voltage signal output circuit 460. The reference voltage signal output circuit 460 includes a comparator 461, transistors 462 and 463, resistors 464, 465, and 466, and an inverter 467. Description will be made on the assumption that the transistor 462 is a PMOS transistor and the transistor 463 is an NMOS transistor.

A reference voltage Vref is supplied to a negative input terminal of the comparator 461. A positive input terminal of the comparator 461 is electrically coupled to one end of the resistor 464 and one end of the resistor 465. An output terminal of the comparator 461 is electrically coupled to a gate terminal of the transistor 462. The voltage signal GVDD is supplied to a source terminal of the transistor 462. A drain terminal of the transistor 462 is electrically coupled to the other end of the resistor 464, one end of the resistor 466, and a terminal VBS-Out from which the reference voltage signal VBS is output. The other end of the resistor 466 is electrically coupled to a drain terminal of the transistor 463. The control signal CNT2 is input to a gate terminal of the transistor 463 via the inverter 467. The ground potential is supplied to a source terminal of the transistor 463 and the other end of the resistor 465.

In the reference voltage signal output circuit 460 configured as described above, when a voltage value supplied to the positive input terminal of the comparator 461 is greater than a voltage value of the reference voltage Vref supplied to the negative input terminal of the comparator 461, the comparator 461 outputs a signal of an H level. At this time, the transistor 462 is turned off. Thus, the voltage signal GVDD is not supplied to the terminal VBS-Out. Meanwhile, when the voltage value supplied to the negative input terminal of the comparator 461 is less than the voltage value of the reference voltage Vref supplied to the negative input terminal of the comparator 461, the comparator 461 outputs a signal of an L level. At this time, the transistor 462 is turned on. Thus, the voltage signal GVDD is supplied to the terminal VBS-Out. That is, the comparator 461 operates to make a voltage value obtained by dividing the reference voltage signal VBS by the resistors 464 and 465 be equal to the voltage value of the reference voltage Vref, and thereby, the reference voltage signal output circuit 460 generates the reference voltage signal VBS having a constant voltage value at the voltage Vbs based on the voltage signal GVDD.

Further, the control signal CNT2 is input to the reference voltage signal output circuit 460. When the control signal CNT2 of an H level is input to the reference voltage signal output circuit 460, the transistor 463 is turned off. Thus, the terminal VBS-Out and the propagation path through which the ground potential is propagated are controlled to have a high impedance. As a result, the reference voltage signal VBS having a constant voltage value at the voltage VBS is output from the terminal VBS-Out. In other words, when the control signal CNT2 of an H level is input to the reference voltage signal output circuit 460, the reference voltage signal output circuit 460 starts to output the reference voltage signal VBS. Meanwhile, when the control signal CNT2 of an L level is input to the reference voltage signal output circuit 460, the transistor 463 is turned on. Thus, the ground potential is supplied to the terminal VBS-Out through the resistor 576 and the transistor 463. As a result, the reference voltage signal output circuit 460 outputs the reference voltage signal VBS which is constant at the ground potential. In other words, when the control signal CNT2 of an L level is input to the reference voltage signal output circuit 460, the reference voltage signal output circuit 460 stops outputting the reference voltage signal VBS and sets a voltage value of the terminal VBS-Out to the ground potential.

The control signal CNT3 is input to the VHV control signal output circuit 470. The VHV control signal output circuit 470 outputs the VHV control signal VHV_CNT supplied to the power supply voltage control circuit 70.

Figure 16:
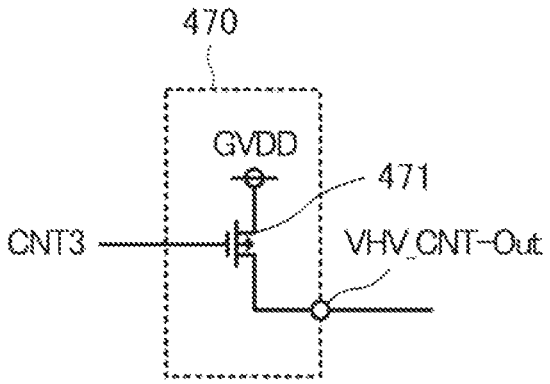
FIG. 16 is a diagram illustrating an example of an electrical configuration of a VHV control signal output circuit.

FIG. 16 is a diagram illustrating an example of an electrical configuration of the VHV control signal output circuit 470. The VHV control signal output circuit 470 includes a transistor 471. Description will be made on the assumption that the transistor 471 is a PMOS transistor.

The voltage signal GVDD is supplied to a source terminal of the transistor 471. A drain terminal of the transistor 471 is electrically coupled to a terminal VHV_CNT-Out. The control signal CNT3 is input to a gate terminal of the transistor 471. When the control signal CNT3 of an L level is input to the VHV control signal output circuit 470 configured as described above, the voltage signal GVDD is supplied to the terminal VHV_CNT-Out, and the control signal CNT3 of an H level is input, the ground potential is supplied to the terminal VHV_CNT-Out. That is, the VHV control signal output circuit 470 inverts a logic level of the control signal CNT3 and outputs a signal amplified to a voltage value of the voltage signal GVDD as the VHV control signal VHV_CNT.

The VHV control signal VHV_CNT output from the VHV control signal output circuit 470 is input to the power supply voltage control circuit 70 illustrated in FIG. 11. The power supply voltage control circuit 70 switches whether or not to supply the voltage signal VHV2 to the print head 21 based on the input VHV control signal VHV_CNT. Specifically, when the control signal CNT3 of an H level is input to the VHV control signal output circuit 470, the VHV control signal output circuit 470 outputs the VHV control signal VHV_CNT of an H level to the power supply voltage control circuit 70. As a result, the power supply voltage control circuit 70 supplies the voltage signal VHV1 to the print head 21 as the voltage signal VHV2. That is, when the control signal CNT3 of an H level is input to the VHV control signal output circuit 470, the power supply voltage control circuit 70 supplies the voltage signal VHV1 to the print head 21 and the selection circuit 230 included in the print head 21 as the voltage signal VHV2. That is, the VHV control signal output circuit 470 controls switching of whether or not to supply the voltage signal VHV1 to the print head 21 as the voltage signal VHV2 in the power supply voltage control circuit 70 based on the control signal CNT3. Here, the voltage signal VHV1 and the voltage signal VHV2 based on the voltage signal VHV1 are examples of power supply voltages supplied to the print head 21 and the selection circuit 230.

The control signal CNT4 is input to the state signal input/output circuit 480. The state signal input/output circuit 480 outputs the state signal BUSY indicating an operation state of the drive control circuit 51 and also receives the state signal BUSY output from another configuration. Here, another configuration may be, for example, another drive control circuit 51 when the liquid ejecting apparatus 1 includes a plurality of drive control circuits 51 and may be, for example, the control signal output circuit 100.

Figure 17:
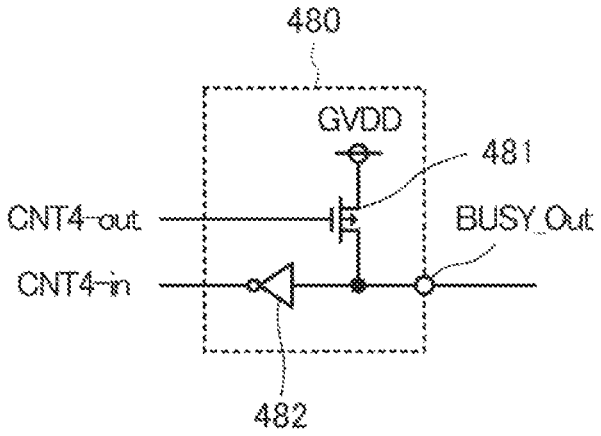
FIG. 17 is a diagram illustrating an example of an electrical configuration of a state signal input/output circuit.

FIG. 17 is a diagram illustrating an example of an electrical configuration of the state signal input/output circuit 480. The state signal input/output circuit 480 includes a transistor 481 and an inverter 482. Description will be made on the assumption that the transistor 481 is a PMOS transistor. Further, the inverter 482 functions as a COMS input terminal of the integrated circuit 500. That is, the state signal input/output circuit 480 outputs the state signal BUSY from the terminal BUSY-Out and outputs a signal input to the terminal BUSY-Out to the register control circuit 440, based on the control signal CNT4 output from the register control circuit 440. In FIG. 17, the control signal CNT4 output from the register control circuit 440 is illustrated as a control signal CNT4-out, and the control signal CNT4 input to the register control circuit 440 is illustrated as a control signal CNT4-in.

The voltage signal GVDD is supplied to a source terminal of the transistor 481. A drain terminal of the transistor 481 is coupled to an input terminal of the inverter 482 and the terminal BUSY-Out. Further, the control signal CNT4-out output from the register control circuit 440 is input to a gate terminal of the transistor 481. Further, the control signal CNT4-in input to the register control circuit 440 is output from an output terminal of the inverter 482. When the control signal CNT4 of an L level is input to the state signal input/output circuit 480 configured as described above, the voltage signal GVDD is supplied to the terminal BUSY-Out. That is, the state signal BUSY of an H level is output.

Figure 18:
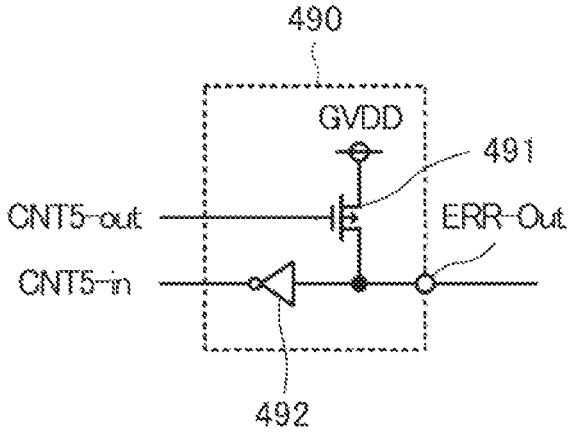
FIG. 18 is a diagram illustrating an example of an electrical configuration of an error signal input/output circuit.

The control signal CNT5 is input to the error signal input/output circuit 490. The error signal input/output circuit 490 outputs the error signal ERR indicating whether or not abnormality occurs in the drive control circuit 51, and also receives the error signal ERR output from another configuration. Here, another configuration may be, for example, another drive control circuit 51 when the liquid ejecting apparatus 1 includes a plurality of drive control circuits 51 and may be, for example, the control signal output circuit 100. FIG. 18 is a diagram illustrating an example of an electrical configuration of the error signal input/output circuit 490. The error signal input/output circuit 490 includes a transistor 491 and an inverter 492. In the following description, the transistor 491 will be described as a PMOS transistor. Further, the inverter 492 functions as the COMS input terminal of the integrated circuit 500. That is, the error signal input/output circuit 490 outputs the error signal ERR from a terminal ERR-Out and outputs a signal input to the terminal ERR-Out to register control circuit 440, based on the control signal CNT5 output from the register control circuit 440. In FIG. 18, the control signal CNT5 output from the register control circuit 440 is illustrated as a control signal CNT5-out, and the control signal CNT5 input to the register control circuit 440 is illustrated as a control signal CNT5-in.

The voltage signal GVDD is supplied to a source terminal of the transistor 491. A drain terminal of the transistor 491 is electrically coupled to an input terminal of the inverter 492 and the terminal ERR-Out. Further, the control signal CNT5-out output from the register control circuit 440 is input to a gate terminal of the transistor 491. The control signal CNT5-in input to the register control circuit 440 is output from an output terminal of the inverter 492. When the control signal CNT5 of an L level is input to the error signal input/output circuit 490 configured as described above, the voltage signal GVDD is supplied to the terminal ERR-Out. That is, the error signal ERR of an H level is output.

As described above, since the drive control circuit 51 includes the state signal input/output circuit 480 and the error signal input/output circuit 490, when the liquid ejecting apparatus 1 includes a plurality of drive control circuits 51, the plurality of drive control circuits 51 can share error information and operation information. Thus, when abnormality occurs in any of the plurality of drive control circuits 51, it is possible to control the operation of another drive control circuit 51 in which no abnormality occurs, based on state information indicating the abnormality.

Further, the register control circuit 440 generates drive data dC1 for controlling the drive signal COM, which is output from the demodulation circuit 560, to have a constant voltage value at the voltage Vos, based on the input drive data signal DATA and inputs the drive data to the DAC section 520. By changing the drive data dC1 output by the register control circuit 440, the voltage Vos, which is a voltage value of the drive signal COM defined by the drive data dC1, may be changeable.

The DAC section 520 converts the input drive data dC1 into the original drive signal aA of an analog signal. The original drive signal aA is a target signal before amplification of the drive signal COM having a constant voltage value. The modulator 530 receives the original drive signal aA. The modulator 530 outputs a modulation signal Ms obtained by performing a pulse width modulation of the original drive signal aA. The gate driver 540 amplifies the input modulation signal Ms based on the voltage signal GVDD and generates the amplification control signal Hgd that is level-shifted to a high amplitude logic based on the voltage signal VHVb, and the amplification control signal Lgd obtained by inverting a logic level of the input modulation signal Ms and amplifying the modulation signal MS based on the voltage signal GVDD. The amplification circuit 550 operates based on the amplification control signals Hgd and Lgd to output the amplification modulation signal AMs, and the demodulation circuit 560 demodulates the amplification modulation signal AMs. Thereby, the demodulation circuit 560 outputs the drive signal COM having a constant voltage value.

Further, the register control circuit 440 generates the drive data dC2 and outputs the drive signal to the constant voltage output circuit 420. The constant voltage output circuit 420 generates the voltage signal VCNT that makes a voltage value of the terminal COM-Out constant at the voltage Vcnt, based on the input drive data dC2, and outputs the voltage signal VCNT to the terminal COM-Out via the terminal COM-Dis and the resistor 571. In other words, the constant voltage output circuit 420 makes a voltage value of the terminal COM-Out constant at the voltage Vcnt, based on the drive data dC2.

Here, the constant voltage output circuit 420 is an example of a constant voltage signal output circuit, and the voltage signal VCNT output by the constant voltage output circuit 420 is an example of a first constant voltage signal. The voltage Vcnt, which is a voltage value of the voltage signal VCNT, is an example of a first voltage value.

Figure 19:
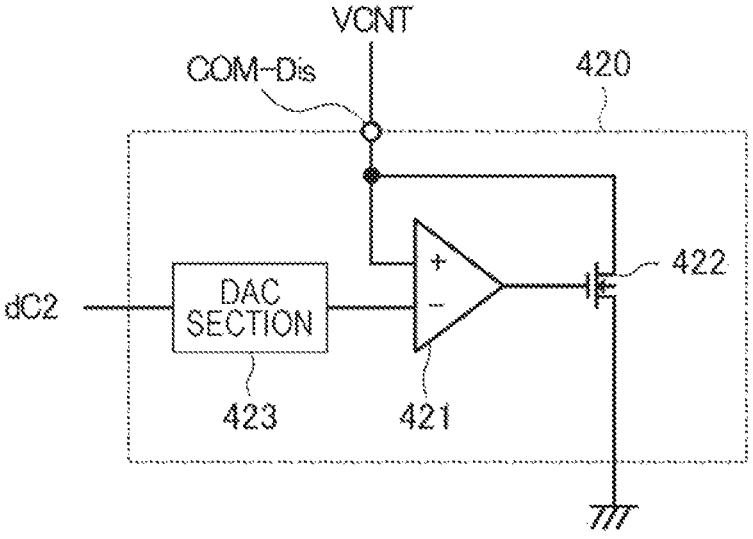
FIG. 19 is a diagram illustrating an example of an electrical configuration of a constant voltage output circuit.

FIG. 19 is a diagram illustrating an example of an electrical configuration of the constant voltage output circuit 420. The constant voltage output circuit 420 includes a comparator 421, a transistor 422, and a DAC 423. Description will be made on the assumption that the transistor 422 is an NMOS transistor.

The drive data dC2 is input to the DAC 423. The DAC 423 inputs a signal having of a voltage value corresponding to the input drive data dC2 to a negative input terminal of the comparator 421. Here, the DAC 423 may include a variable DC power supply that outputs a signal having a voltage value according to the input drive data dC2. A positive input terminal of the comparator 421 is electrically coupled to the terminal COM-Dis. An output terminal of the comparator 421 is electrically coupled to a gate terminal of the transistor 422. A drain terminal of the transistor 422 is electrically coupled to the terminal COM-Dis. Further, the ground potential is supplied to a source terminal of the transistor 422.

In the constant voltage output circuit 420 configured as described above, when a voltage value supplied to the positive input terminal of the comparator 421 is greater than a voltage value supplied to the negative input terminal of the comparator 421, the comparator 421 outputs a signal of an H level. That is, when a voltage value of the terminal COM-Dis is greater than a voltage value output from the DAC 423 defined by the drive data dC2, the comparator 421 outputs the signal of an H level. Thus, the transistor 422 is turned on. As a result, the voltage value of the terminal COM-Dis is reduced. Meanwhile, when the voltage value supplied to the positive input terminal of the comparator 421 is less than the voltage value supplied to the negative input terminal of the comparator 421, the comparator 421 outputs a signal of an L level. That is, when the voltage value of the terminal COM-Dis is less than a voltage value output from the DAC 423 defined by the drive data dC2, the comparator 421 outputs the signal of an L level. Thus, the transistor 422 is turned off. As a result, the voltage signal VHV2 is supplied to the terminal COM-Dis via the resistor 572, and the voltage value of the terminal COM-Dis increased.

Thus, the constant voltage output circuit 420 controls an operation of the transistor 422 such that a voltage value of the terminal COM-Dis becomes a voltage defined by the drive data dC2 output from the DAC 423. As a result, a voltage value of the terminal COM-Out electrically coupled to the terminal COM-Dis via the resistor 571 is controlled to the voltage Vcnt.

The drive data dC1 and dC2 may be a value obtained by reading a value previously stored in a register (not illustrated) by the register control circuit 440 or may be appropriately changed based on the drive data signal DATA input to the drive circuit 50.

Here, a configuration including the modulator 530, the amplification circuit 550, and the demodulation circuit 560 that output the drive signal COM, and the constant voltage output circuit 420 that outputs the voltage signal VCNT having a constant voltage value at the voltage Vcnt is the drive signal output circuit 501.

5. Sequence Control of Liquid Ejecting Apparatus and Drive Circuit

In the drive control circuit 51 configured as described above, state transition information included in the drive data signal DATA is held in the sequence register 441 included in the register control circuit 440 in synchronization with the clock signal MCK. Then, the register controller 443 included in the register control circuit 440 causes the drive control circuit 51 to perform a sequence control based on the state transition information held in the sequence register 441. As the sequence control of the drive control circuit 51 is performed, operation state information indicating an operation state of the drive control circuit 51 is appropriately held in the state register 442. The register control circuit 440 outputs the control signals CNT1 to CNT5 and the drive data dC1 and dC2 according to the operation state information held in the state register 442.

Figure 20:
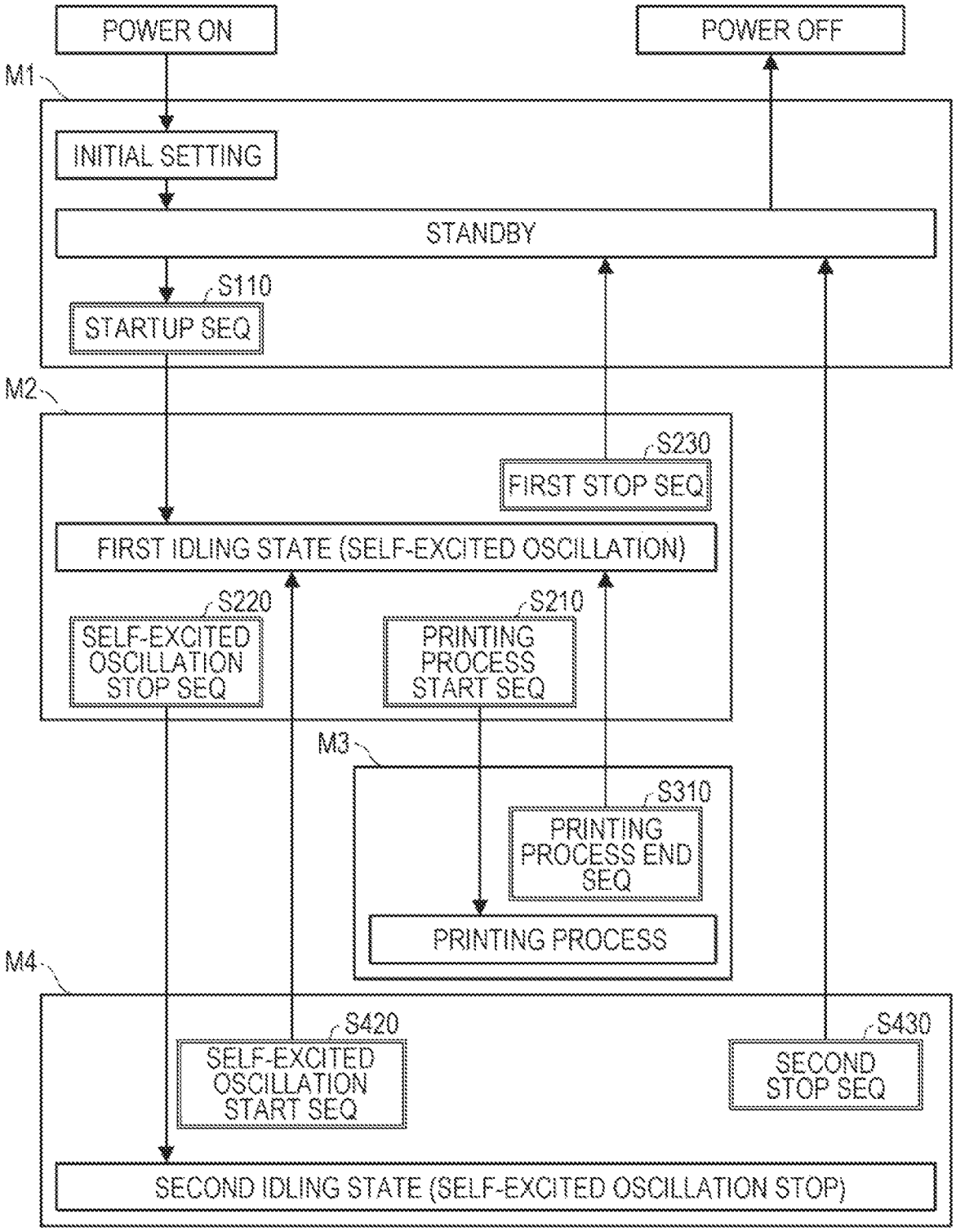
FIG. 20 is a diagram illustrating a state transition of the liquid ejecting apparatus and the drive control circuit.

Here, an operation of the liquid ejecting apparatus accompanying the sequence control of the drive control circuit 51 will be described with reference to FIGS. 20 to 27. FIG. 20 is a diagram illustrating a state transition of the liquid ejecting apparatus 1 and the drive control circuit 51.

As illustrated in FIG. 20, the liquid ejecting apparatus 1 includes four modes of a startup mode M1, a first standby mode M2, a printing mode M3, and a second standby mode M4. The liquid ejecting apparatus 1 performs a state transition among the startup mode M1, the first standby mode M2, the printing mode M3, and the second standby mode M4 based on state transition information held in the sequence register 441. Modes of the liquid ejecting apparatus 1 are not limited to the four modes of the startup mode M1, the first standby mode M2, the printing mode M3, and the second standby mode M4, and an abnormality process mode when abnormality occurs in the liquid ejecting apparatus 1, a maintenance mode for performing a maintenance process of the liquid ejecting apparatus 1, and the like may be included.

As illustrated in FIG. 20, when power is supplied to the liquid ejecting apparatus 1, the liquid ejecting apparatus 1 enters the startup mode M1.

In the startup mode M1, the drive control circuit 51 stands by for a certain period after performing initial setting of the liquid ejecting apparatus 1. Here, in the initial setting of the liquid ejecting apparatus 1, the first power supply circuit 90*a* starts generating the voltage signal VHV1, the second power supply circuit 90*b* starts generating the voltage signal VDD, the control signal output circuit 100 controls all the selection circuits 230 to be non-conductive, and the like.

Further, in the startup mode M1, the control signals CNT1 to CNT3 are controlled to an L level. Thereby, in the startup mode M1, supply of the voltage signal VHV2 to the print head 21 is blocked, electric charges stored in the terminal COM-Out are released, and supply of the reference voltage signal VBS to the print head 21 is stopped. Thus, in the startup mode M1, a ground potential is supplied to both the electrodes 611 and 612 of the piezoelectric element 60. As a result, a possibility that a potential difference occurs between the electrodes 611 and 612 of the piezoelectric element 60 is reduced. In other words, and a possibility that unintended stress is generated in the piezoelectric element 60 and a possibility that a reverse voltage is supplied to the piezoelectric element 60 are reduced.

In the first standby mode M2, the control signal output circuit 100 controls all the selection circuits 230 to be conductive. Further, in the first standby mode M2, the register control circuit 440 controls the control signals CNT1 to CNT3 to an H level. Thereby, in the first standby mode M2, the voltage signal VHV2 is supplied to the print head 21, release of electric charges of the terminal COM-Out is stopped, and the reference voltage signal VBS is supplied to the print head 21. Further, in the first standby mode M2, the register control circuit 440 generates the drive data dC1 for generating the drive signal COM having a constant voltage value at the voltage Vos and outputs the drive data dC1 to the DAC section 520. Thus, the drive signal output circuit 501 outputs the drive signal COM having a constant voltage value at the voltage Vos to the terminal COM-Out. In this case, an operation of the constant voltage output circuit 420 stops.

Thereby, in the first standby mode M2, the electrode 611 of the piezoelectric element 60 receives the drive signal COM having a constant voltage value at the voltage Vos based on the drive data dC1, and the electrode 612 receives the reference voltage signal VBS having a constant voltage value at the voltage Vbs which is output from the reference voltage signal output circuit 460. That is, in the first standby mode M2, the voltage value supplied to the electrode 611 of the piezoelectric element 60 and the voltage value supplied to the electrode 612 thereof are controlled by the drive circuit 50. Thus, in the first standby mode M2, a possibility that the voltage values supplied to the electrodes 611 and 612 of the piezoelectric element 60 are not defined is reduced, and as a result, a possibility that unintended stress occurs in the piezoelectric element 60 and a possibility that an unintended reverse voltage is supplied to the piezoelectric element 60 are reduced.

Here, in the first standby mode M2, the drive signal COM having a constant voltage value at the voltage Vos based on the drive data dC1 is supplied to the terminal COM-Out.

That is, the amplification control signal generation circuit 502 and the amplification circuit 550 perform a self-excited oscillation. However, the electrode 611 of the piezoelectric element 60 receives the drive signal COM having a constant voltage value at the voltage Vos, and thus, the piezoelectric element 60 is not driven. Therefore, in the first standby mode M2, no ink is ejected from the print head 21. A state of the first standby mode M2 in which the amplification control signal generation circuit 502 and the amplification circuit 550 perform a self-excited oscillation and no ink is ejected from the print head 21 may be referred to as a first idling state.

Further, in the first idling state, the voltage Vos, which is a voltage value defined based on the drive data dC1, may be controlled to the same value as the voltage Vbs which is a voltage value of reference voltage signal VBS. Here, the same value is not limited to a voltage value in which the voltage Vos completely coincides with the voltage Vbs, includes a case that is substantially the same voltage value, and includes a case where the voltage Vos and the voltage Vbs have substantially the same voltage value, for example, a case in which the voltage Vos and the voltage Vbs have substantially the same voltage value when a circuit fluctuation of the drive circuit 50 is added.

Specifically, in the first idling state, the voltage Vos, which is a voltage value of the drive signal COM, is closer to the voltage Vbs which is a voltage value of the reference voltage signal VBS than a maximum voltage value of the drive signal COM of which voltage value varies as illustrated in FIG. 3 and is closer to the voltage Vbs than a minimum voltage value of the drive signal COM of which voltage value varies as illustrated in FIG. 3. In other words, a difference between the voltage Vbs and the voltage Vos is smaller than a difference between the maximum voltage value of the drive signal COM of which voltage value varies as illustrated in FIG. 3 and the voltage Vbs, and is smaller than a difference between the minimum voltage value of the drive signal COM of which voltage value varies as illustrated in FIG. 3 and the voltage Vbs.

Furthermore, in the first idling state, the voltage Vos which is the voltage value of the drive signal COM is closer to the voltage Vbs than an average voltage value of the drive signal COM. In other words, a difference between an average voltage value of the reference voltage signal VBS and the voltage Vos is smaller than the difference between the average voltage value of the drive signal COM and the voltage Vbs.

As described above, by controlling the voltage Vos and the voltage Vbs to the same voltage value, it is possible to further reduce a possibility that unintended stress occurs in the piezoelectric element 60.

In the printing mode M3, the control signal output circuit 100 generates the clock signal SCK, the printing data signal SI, the latch signal LAT, and the change signal CH for individually controlling the selection circuit 230 to be conductive or non-conductive, and outputs the signals to the drive signal selection control circuit 200. Thus, in the printing mode M3, the selection circuit 230 is controlled to be conductive or non-conductive according to the clock signal SCK, the printing data signal SI, the latch signal LAT, and the change signal CH. Further, in the printing mode M3, the register control circuit 440 controls all the control signals CNT1 to CNT3 to an H level. Thereby, in the printing mode M3, the voltage signal VHV2 is supplied to the print head 21, release of electric charges of the terminal COM-Out is stopped, and the reference voltage signal VBS is supplied to the print head 21. Further, in the printing mode M3, the drive signal output circuit 501 outputs, to the terminal COM-Out, the drive signal COM which is obtained by amplifying a signal having a waveform defined by the drive data signal DATA input from the control signal output circuit 100 and of which voltage value varies as illustrated in FIG. 3. In this case, an operation of the constant voltage output circuit 420 stops.

Thereby, in the printing mode M3, the drive signal COM in which a voltage value for driving the piezoelectric element 60 varies is supplied to the electrode 611 of the piezoelectric element 60, and the reference voltage signal VBS having a constant voltage value at the voltage Vbs is supplied to the electrode 612. That is, in the printing mode M3, the voltage value supplied to the electrode 611 of the piezoelectric element 60 and the voltage value supplied to the electrode 612 thereof are controlled by the drive circuit 50. Thus, in the printing mode M3, a possibility that the voltage values supplied to the electrodes 611 and 612 of the piezoelectric element 60 are not defined is reduced, and as a result, a possibility that unintended stress occurs in the piezoelectric element 60 and a possibility that an unintended reverse voltage is supplied to the piezoelectric element 60 are reduced.

Here, in the printing mode M3, the drive signal COM which is obtained by amplifying a signal having a waveform defined by the drive data signal DATA and of which voltage value varies as illustrated in FIG. 3 is supplied to the terminal COM-Out. That is, the amplification control signal generation circuit 502 and the amplification circuit 550 perform a self-excited oscillation. The piezoelectric element 60 is driven by a potential difference between the drive signal COM of which voltage value varies and the reference voltage signal VBS, and ink of an amount corresponding to a drive of the piezoelectric element 60 is ejected from the nozzle 651. That is, in the printing mode M3, a print process of ejecting ink onto the medium P is performed.

In the second standby mode M4, the control signal output circuit 100 controls all the selection circuits 230 to be conductive. Further, in the second standby mode M4, the register control circuit 440 controls the control signals CNT1 to CNT3 to an H level. Thereby, in the second standby mode M4, the voltage signal VHV2 is supplied to the print head 21, release of electric charges of the terminal COM-Out is stopped, and the reference voltage signal VBS is supplied to the print head 21. Further, in the second standby mode M4, the register control circuit 440 generates the drive data dC2 for generating the voltage signal VCNT having a constant voltage value at the voltage Vcnt, and outputs the drive data dC2 to the constant voltage output circuit 420. Thus, the drive signal output circuit 501 outputs the voltage signal VCNT having a constant voltage value at the voltage Vcnt to the terminal COM-Out. In this case, the amplification control signal generation circuit 502 and the amplification circuit 550 stop operations thereof. In other words, the amplification control signal generation circuit 502 and the amplification circuit 550 stop a self-excited oscillation.

Thereby, in the second standby mode M4, the electrode 611 of the piezoelectric element 60 receives the voltage signal VCNT having a constant voltage value at the voltage Vcnt based on the drive data dC2, and the electrode 612 receives the reference voltage signal VBS having a constant voltage value at the voltage Vbs which is output from the reference voltage signal output circuit 460. That is, in the second standby mode M4, the voltage value supplied to the electrode 611 of the piezoelectric element 60 and the voltage value supplied to the electrode 612 thereof are controlled by the drive circuit 50. Thus, in the second standby mode M4, a possibility that the voltage values supplied to the electrodes 611 and 612 of the piezoelectric element 60 are not defined is reduced, and as a result, a possibility that unintended stress occurs in the piezoelectric element 60 and a possibility that an unintended reverse voltage is supplied to the piezoelectric element 60 are reduced.

Here, in the second standby mode M4, the voltage signal VCNT having a constant voltage value at the voltage Vcnt based on the drive data dC2 is supplied to the terminal COM-Out. In this case, the amplification control signal generation circuit 502 and the amplification circuit 550 stop a self-excited oscillation. Further, since the electrode 611 of the piezoelectric element 60 receives the voltage signal VCNT having a constant voltage value at the voltage Vcnt, the piezoelectric element 60 is not driven. Therefore, in the second standby mode M4, no ink is ejected from the print head 21. A state of the second standby mode M4 in which the amplification control signal generation circuit 502 and the amplification circuit 550 stop a self-excited oscillation and no ink is ejected from the print head 21 may be referred to as a second idling state.

Further, in the second idling stat, the voltage Vcnt having a voltage value defined based on the drive data dC2 may be controlled to the same value as the voltage Vbs which is a voltage value of the reference voltage signal VBS. Here, the same value is not limited to a voltage value in which the voltage Vcnt completely coincides with the voltage Vbs, and includes a case that is substantially the same voltage value, for example, a case in which the voltage Vcnt and the voltage Vbs have substantially the same voltage value when a circuit fluctuation of the drive circuit 50 is added.

Specifically, in the second idling state, the voltage Vcnt, which is a voltage value of the voltage signal VCNT, is closer to the voltage Vbs which is a voltage value of the reference voltage signal VBS than a maximum voltage value of the drive signal COM of which voltage value varies as illustrated in FIG. 3 and is closer to the voltage Vbs than a minimum voltage value of the drive signal COM of which voltage value varies as illustrated in FIG. 3. In other words, a difference between the voltage Vbs and the voltage Vcnt is smaller than a difference between the maximum voltage value of the drive signal COM of which voltage value varies as illustrated in FIG. 3 and the voltage Vbs, and is smaller than a difference between the minimum voltage value of the drive signal COM of which voltage value varies as illustrated in FIG. 3 and the voltage Vbs.

Furthermore, in the second idling state, the voltage Vcnt which is the voltage value of the voltage signal VCNT is closer to the voltage Vbs than an average voltage value of the drive signal COM. In other words, a difference between an average voltage value of the reference voltage signal VBS and the voltage Vcnt is smaller than a difference between the average voltage value of the drive signal COM and the voltage Vbs.

As described above, by controlling the voltage Vcnt and the voltage Vbs to have the same voltage value, a possibility that unintended stress occurs in the piezoelectric element 60 is further reduced.

Here, as described above, the second standby mode M4 is different from the first standby mode M2 in that the liquid ejecting apparatus 1 stands by in a state in which the drive signal output circuit 501 stops a self-excited oscillation. In the first standby mode M2, the liquid ejecting apparatus 1 is caused to stand by in a state in which the drive signal output circuit 501 continues the self-excited oscillation, and thus, when a printing process execution request is issued, transition to the printing mode M3 can be performed in a short time. In contrast to this, in the second standby mode M4, the liquid ejecting apparatus 1 is caused to stand by in a state in which the drive signal output circuit 501 stops the self-excited oscillation, and thus, a standby power can be reduced. Here, in the second standby mode M4, when the drive signal output circuit 501 stops oscillation, the amplification control signal generation circuit 502, the amplification circuit 550, the demodulation circuit 560, and the feedback circuit 570 included in the drive signal output circuit 501 may stop operations, and at least the amplification circuit 550 including the transistors 551 and 552 that consume large power may stop an operation. Thereby, it is possible to reduce power consumption of the liquid ejecting apparatus 1 in the second standby mode M4.

Next, details of state transitions among the startup mode M1, the first standby mode M2, the printing mode M3, and the second standby mode M4 will be described. In the liquid ejecting apparatus 1 according to the present embodiment, the state transitions among the startup mode M1, the first standby mode M2, the printing mode M3, and the second standby mode M4 start as a signal for executing the state transition included in the drive data signal DATA is held in the sequence register 441. The register control circuit 440 executes various sequence processes such as a startup sequence (SEQ) S110, a printing process start sequence S210, a printing process end sequence S310, a self-excited oscillation stop sequence S220, a self-excited oscillation start sequence S420, a first stop sequence S230, and a second stop sequence S430, from a state of a transition source and a state of a transition destination.

Figure 21:
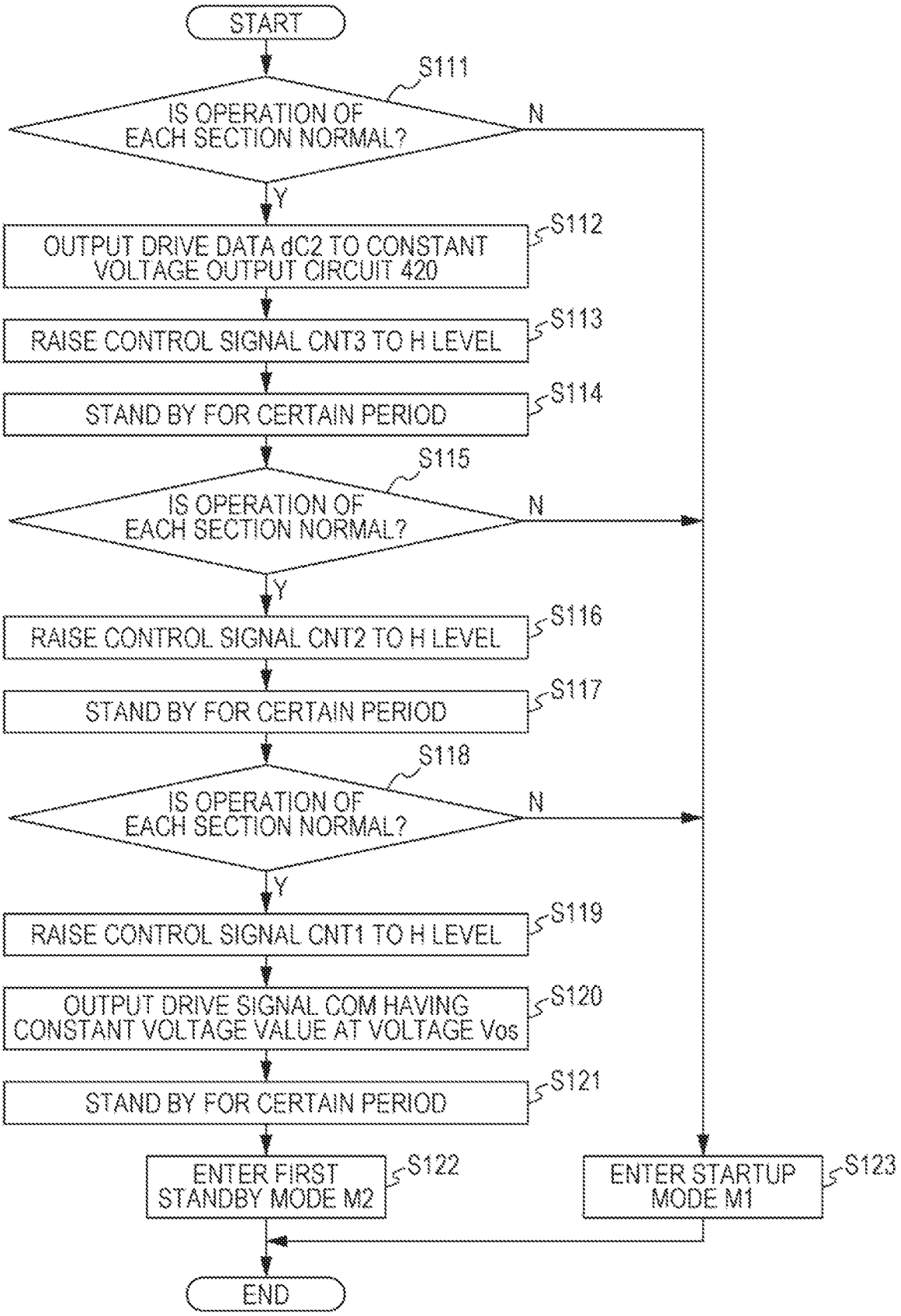
FIG. 21 is a diagram illustrating a sequence control of a startup sequence.

First, a specific example of the startup sequence S110 which is a state transition from the startup mode M1 to the first standby mode M2 will be described with reference to FIG. 21. FIG. 21 is a diagram illustrating a sequence control in the startup sequence S110. When the liquid ejecting apparatus 1 is in the startup mode M1 and state transition information for state transition to the first standby mode M2 is held in the sequence register 441, the register control circuit 440 executes the startup sequence S110.

By executing the startup sequence S110, the register control circuit 440 determines whether or not operations of the respective sections of the drive control circuit 51 and the drive circuit 50 is normal based on the input error signals NES and FES (S111). When the operations of respective sections of the drive control circuit 51 and the drive circuit 50 are normal (Y of S111), the register control circuit 440 generates the drive data dC2 for outputting the voltage signal VCNT having a constant voltage value at the voltage Vcnt to output to the constant voltage output circuit 420 (S112). Thereafter, the register control circuit 440 raises the control signal CNT3 to an H level (S113). Thereby, supply of the voltage signal VHV2 to the drive signal selection control circuit 200 is started. The register control circuit 440 holds the drive control circuit 51 in this state for a certain period. In other words, the sequence control of the drive control circuit 51 is caused to stand by for a certain period (S114).

After a certain period elapses, the register control circuit 440 determines whether or not the operations of the respective sections of the drive control circuit 51 and the drive circuit 50 are normal based on the input error signals NES and FES (S115). When the operations of the respective sections of the drive control circuit 51 and the drive circuit 50 are normal (Y in S115), the register control circuit 440 raises the control signal CNT2 to an H level (S116). Thereby, output of the reference voltage signal VBS to the electrode 612 of the piezoelectric element 60 starts. In this case, the transfer gate 234 is controlled to be off in the initial setting described above. Accordingly, a voltage value of the electrode 611 of the piezoelectric element 60 increases as the reference voltage signal VBS is supplied to the electrode 612. Thus, the voltage value of the electrode 611 of the piezoelectric element 60 and a voltage value of the electrode 612 rise in a state of holding a voltage value of substantially the same value. The register control circuit 440 holds the drive control circuit 51 in this state for a certain period. In other words, the sequence control of the drive control circuit 51 is caused to stand by for a certain period of time (S117).

After the certain period elapses, the register control circuit 440 determines whether or not the operations of the respective sections of the drive control circuit 51 and the drive circuit 50 are normal based on the input error signals NES and FES (S118). When the operations of the respective sections of the drive control circuit 51 and the drive circuit 50 are normal (Y in S118), the register control circuit 440 raises the control signal CNT1 to an H level (S119). Thereby, release of electric charges of the terminal COM-Out is stopped. The register control circuit 440 starts a self-excited oscillation of the drive signal output circuit 501, and the drive signal output circuit 501 generates the drive signal COM having a constant voltage value at the voltage Vos, based on the drive data dC1. That is, the drive signal output circuit 501 starts the self-excited oscillation and outputs the drive signal COM having a constant voltage value at the voltage Vos (S120).

In this case, the voltage Vos is set to the same value as the voltage Vbs which is a voltage value of the reference voltage signal VBS. Thus, a voltage value of the drive signal COM output from the drive signal output circuit 501 is controlled to approach the voltage value of the reference voltage signal VBS output from reference voltage signal output circuit 460. The register control circuit 440 holds the drive control circuit 51 in this state for a certain period. In other words, a sequence control of the drive control circuit 51 is caused to stand by for a certain period (S121). After the certain period elapses, transition to the first standby mode M2 is performed in the liquid ejecting apparatus 1. In other words, the drive control circuit 51 enters the first standby mode M2 (S122).

Further, when the register control circuit 440 determines that the operations of the respective sections of the drive control circuit 51 and the drive circuit 50 are not normal based on the input error signals NES and FES (N in S111, N in S115, and N in S118), the register control circuit 440 stops executing the startup sequence S110. Transition of the liquid ejecting apparatus 1 to the startup mode M1 is performed. Thus, the drive control circuit 51 enters the startup mode M1 (S123).

As described above, in the startup sequence S110 in which the drive control circuit 51 is in a state transition from the startup mode M1 to the first standby mode M2, before the reference voltage signal output circuit 460 starts an output of the reference voltage signal VBS, the terminal TG-In and the terminal TG-Out of the selection circuit 230 are controlled to be non-conductive, and the drive signal output circuit 501 outputs the voltage signal VCNT having a constant voltage value at the voltage Vcnt.

When the selection circuit 230 and the transfer gate 234 included in the selection circuit 230 are controlled to be non-conductive, no current ideally flows through the selection circuit 230 and between the terminal TG-In and the terminal TG-Out of the transfer gate 234 included in the selection circuit 230. However, as illustrated in FIG. 5, since the transfer gate 234 includes the transistor 235 which is an NMOS transistor and the transistor 236 which is a PMOS transistor, there is a possibility that a leakage current flows between the terminals TG-In and the terminal TG-Out of the transfer gate 234. When the leakage current flows between the terminal TG-In and the terminal TG-Out of the transfer gate 234, a potential of the electrode 611 of the piezoelectric element 60 is defined by the leakage current. As a result, there is a possibility that the potential of the electrode 611 of the piezoelectric element 60 is not defined.

With respect to this problem, the drive signal output circuit 501 outputs the voltage signal VCNT having a constant voltage value at the voltage Vcnt in a state in which the terminal TG-In and the terminal TG-Out of the selection circuit 230 are controlled to be non-conductive, and thus, a potential of the electrode 611 of the piezoelectric element 60 is controlled to be at the voltage VCNT having a constant voltage value at the voltage Vcnt, even if a leakage current flows between the terminal TG-In and the terminal TG-Out of the transfer gate 234. Further, before the reference voltage signal output circuit 460 starts to output the reference voltage signal VBS, the drive signal output circuit 501 outputs the voltage signal VCNT having a constant voltage value at the voltage Vcnt, and thus, it is possible to control the potential of the electrode 611 of the piezoelectric element 60 to the voltage signal VCNT having a constant voltage value at the voltage Vcnt in a state in which the potential of the electrode 612 of the piezoelectric element 60 is controlled to the ground potential, and a possibility that a reverse voltage is supplied to the piezoelectric element 60 is reduced.

Further, in the startup sequence S110 in which a state transition of the drive control circuit 51 from the startup mode M1 to the first standby mode M2 is performed, before the reference voltage signal output circuit 460 starts to output the reference voltage signal VBS, the voltage signal VHV2 is supplied to the selection circuit 230.

As described above, when the selection circuit 230 and the transfer gate 234 included in the selection circuit 230 are controlled to be non-conductive, there is a possibility that a leakage current due to the voltage signal VHV2 supplied to the transfer gate 234 flows into the terminal TG-Out because the transfer gate 234 is configured to include the transistor 235 which is an NMOS transistor and the transistor 236 which is a PMOS transistor, and as a result, there is a possibility that the potential of the electrode 611 of the piezoelectric element 60 is not defined.

With respect to this problem, in the startup sequence S110 shifting to the second standup mode M4 in which the selection circuit 230 and the transfer gate 234 included in the selection circuit 230 are controlled to be conductive, the voltage signal VHV2 starts to be supplied to the selection circuit 230, and thus, in the startup mode M1 in which the selection circuit 230 is controlled to be non-conductive, a possibility that the leakage current due to the voltage signal VHV2 is supplied to the electrode 611 of the piezoelectric element 60 is reduced. That is, a possibility that unintended stress occurs in the piezoelectric element 60 due to no definition of the potential of the electrode 611 of the piezoelectric element 60 over a long period of time.

By supplying the voltage signal VHV2 to the selection circuit 230 before the reference voltage signal output circuit 460 starts to output the reference voltage signal VBS, even if a leakage current due to the voltage signal VHV2 flows through the transfer gate 234 to be supplied to the electrode 611 of the piezoelectric element 60, a possibility that a reverse voltage is supplied to the piezoelectric element 60 is reduced because the potential of the electrode 612 of the piezoelectric element 60 is controlled to the ground potential.

Then, after the reference voltage signal output circuit 460 starts to output the reference voltage signal VBS, the demodulation circuit 560 outputs the drive signal COM having a constant voltage value at the voltage Vos. As described above, when the demodulation circuit 560 outputs the drive signal COM having a constant voltage value at the voltage Vos, the drive signal output circuit 501 starts a self-excited oscillation. After the reference voltage signal output circuit 460 starts to output the reference voltage signal VBS, the demodulation circuit 560 outputs the drive signal COM having a constant voltage value at the voltage Vos, and thus, it is possible to delay timing when the drive signal output circuit 501 start a self-excited oscillation and to reduce power consumption of the drive circuit 50. Here, the voltage Vos is an example of a third voltage value.

Next, specific examples of a printing process start sequence S210 and the printing process end sequence S310, which are state transitions between the first standby mode M2 and the printing mode M3, will be described with reference to FIGS. 22 and 23.

Figure 22:
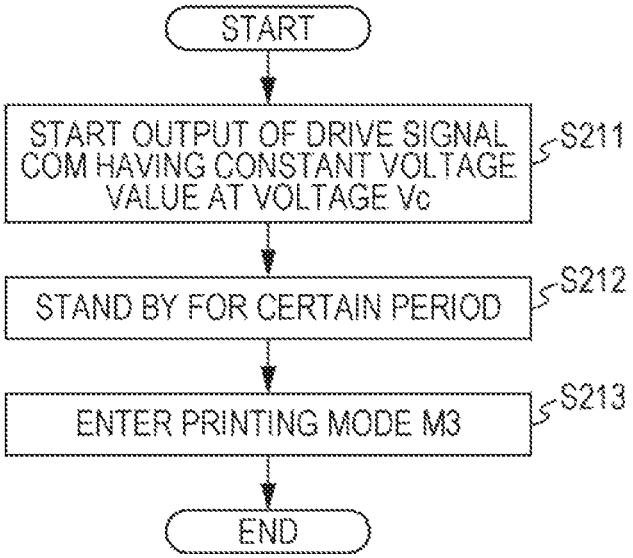
FIG. 22 is a diagram illustrating a sequence control of a printing process start sequence.

FIG. 22 is a diagram illustrating a sequence control of the printing process start sequence S210. When the liquid ejecting apparatus 1 is in the first standby mode M2 and state transition information for state transition to the printing mode M3 is held in the sequence register 441, the register control circuit 440 executes the printing process start sequence S210.

By executing the printing process start sequence S210, the register control circuit 440 controls the drive signal output circuit 501 to generate the drive signal COM having a constant voltage value at the voltage Vc, based on the drive data signal DATA. That is, the drive signal output circuit 501 outputs the drive signal COM having a constant voltage value at the voltage Vc (S211). After that, the register control circuit 440 holds the drive control circuit 51 in this state for a certain period. In other words, the sequence control of the drive control circuit 51 is caused to stand by for a certain period (S212). After the certain period elapsed, transition to the printing mode M3 is performed in the liquid ejecting apparatus 1. Thus, the drive control circuit 51 enters the printing mode M3 (S213).

Figure 23:
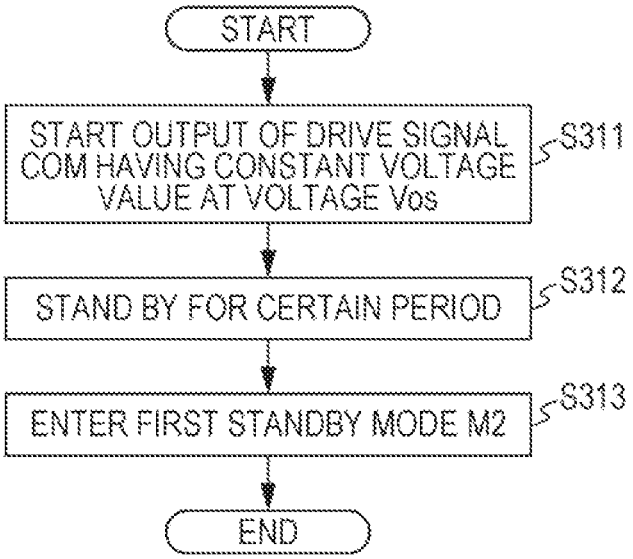
FIG. 23 is a diagram illustrating a sequence control of a printing process end sequence.

FIG. 23 is a diagram illustrating a sequence control of the printing process end sequence S310. If the liquid ejecting apparatus 1 is in the printing mode M3 and a printing process ends, state transition information for state transition to the first standby mode M2 is held in the sequence register 441. Thereby, the register control circuit 440 executes the printing process end sequence S310.

By executing the printing process end sequence S310, the register control circuit 440 controls the drive signal output circuit 501 to generate the drive signal COM having a constant voltage value at the voltage Vos, based on the drive data dC1. In other words, the drive signal output circuit 501 outputs the drive signal COM having the constant voltage value at the voltage Vos (S311). In this case, the voltage Vos is set to the same value as the voltage Vbs which is a voltage value of the reference voltage signal VBS. Thus, when transition is made from the printing mode M3 to the first standby mode M2, the drive signal output circuit 501 is controlled such that a voltage value of the drive signal COM approaches a voltage value of the reference voltage signal VBS. After that, the register control circuit 440 holds the drive control circuit 51 in this state for a certain period. In other words, the sequence control of the drive control circuit 51 is caused to stand by for a certain period (S312). After the certain period elapses, transition to the first standby mode M2 is performed in the liquid ejecting apparatus 1. Thus, the drive control circuit 51 enters the first standby mode M2 (S313).

Next, specific examples of the self-excited oscillation stop sequence S220 and the self-excited oscillation start sequence S420, which are state transitions between the first standby mode M2 and the second standby mode M4, will be described with reference to FIGS. 24 and 25.

Figure 24:
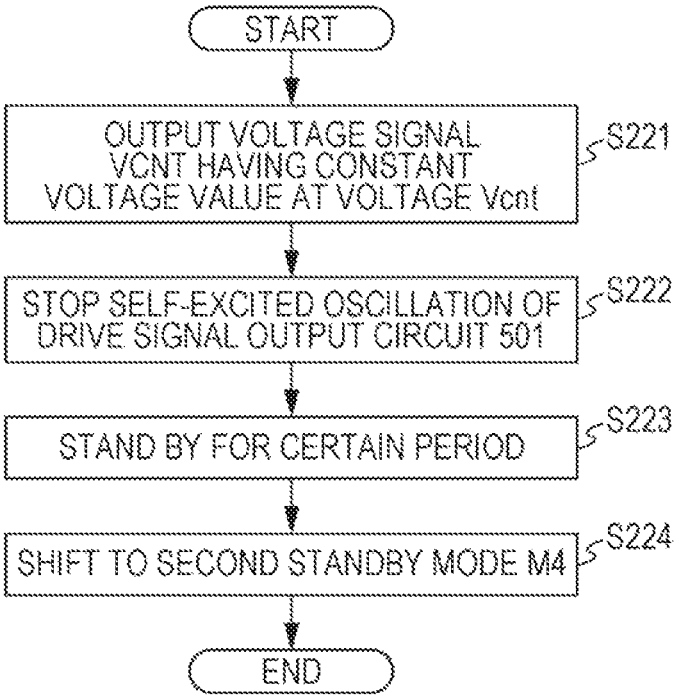
FIG. 24 is a diagram illustrating a sequence control of a self-excited oscillation stop sequence.

FIG. 24 is a diagram illustrating a sequence control of the self-excited oscillation stop sequence S220. When the liquid ejecting apparatus 1 is in the first standby mode M2 and state transition information for state transition to the second standby mode M4 is held in the sequence register 441, the register control circuit 440 executes the self-excited oscillation stop sequence S220. That is, the second standby mode M4 is performed after the first standby mode M2.

By executing the self-excited oscillation stop sequence S220, the register control circuit 440 controls the constant voltage output circuit 420 to generate the voltage signal VCNT having a constant voltage value at the voltage Vcnt, based on the drive data dC2. In other words, the constant voltage output circuit 420 outputs the voltage signal VCNT having the constant voltage value at the voltage Vcnt (S221). In this case, the voltage Vcnt is set to the same value as the voltage Vbs which is a voltage value of the reference voltage signal VBS. The register control circuit 440 controls such that a self-excited oscillation of the drive signal output circuit 501 stops. That is, the self-excited oscillation of the drive signal output circuit 501 stops (S222). After that, the register control circuit 440 holds the drive control circuit 51 in this state for a certain period. In other words, the sequence control of the drive control circuit 51 is caused to stand by for a certain period (S223). After the certain period elapses, transition to the second standby mode M4 is performed in the liquid ejecting apparatus 1. Thus, the drive control circuit 51 enters the second standby mode M4 (S224).

Figure 25:
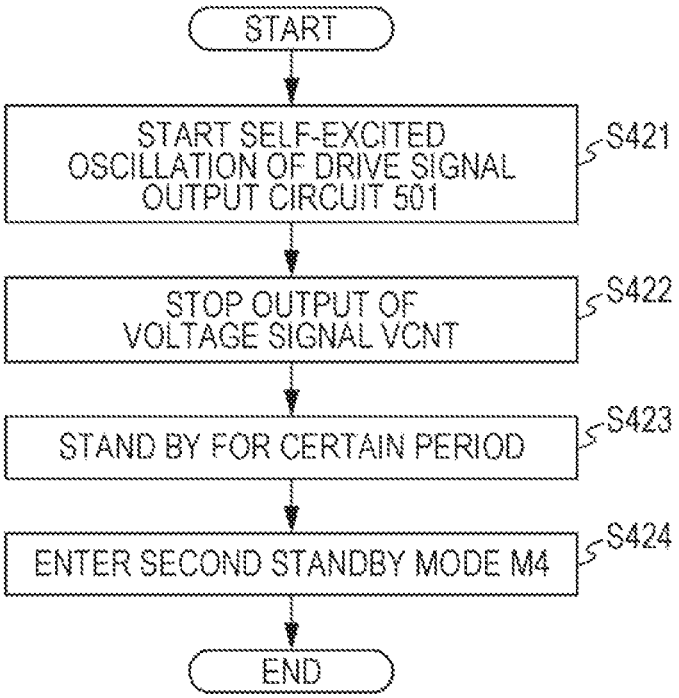
FIG. 25 is a diagram illustrating a sequence control of a self-excited oscillation start sequence.

FIG. 25 is a diagram illustrating a sequence control of the self-excited oscillation start sequence S420. When the liquid ejecting apparatus 1 is in the second standby mode M4 and state transition information for state transition to the first standby mode M2 is held in the sequence register 441, the register control circuit 440 starts a self-excited oscillation start sequence S420.

By executing the self-excited oscillation start sequence S420, the register control circuit 440 controls the drive signal output circuit 501 to start the self-excited oscillation. That is, the drive signal output circuit 501 starts the self-excited oscillation (S421). By starting the self-excited oscillation of the drive signal output circuit 501, the register control circuit 440 controls the constant voltage output circuit 420 to stop outputting the voltage signal VCNT. That is, output of the voltage signal VCNT stops (S422). After that, the register control circuit 440 holds the drive control circuit 51 in this state for a certain period. In other words, the sequence control of the drive control circuit 51 is caused to stand by for a certain period (S423). After the certain period elapses, transition to the second standby mode M4 is performed in the liquid ejecting apparatus 1. Thus, the drive control circuit 51 enters the second standby mode M4 (S424).

Next, the first stop sequence S230, which is a state transition from the first standby mode M2 to the startup mode M1, will be described with reference to FIG. 26.

Figure 26:
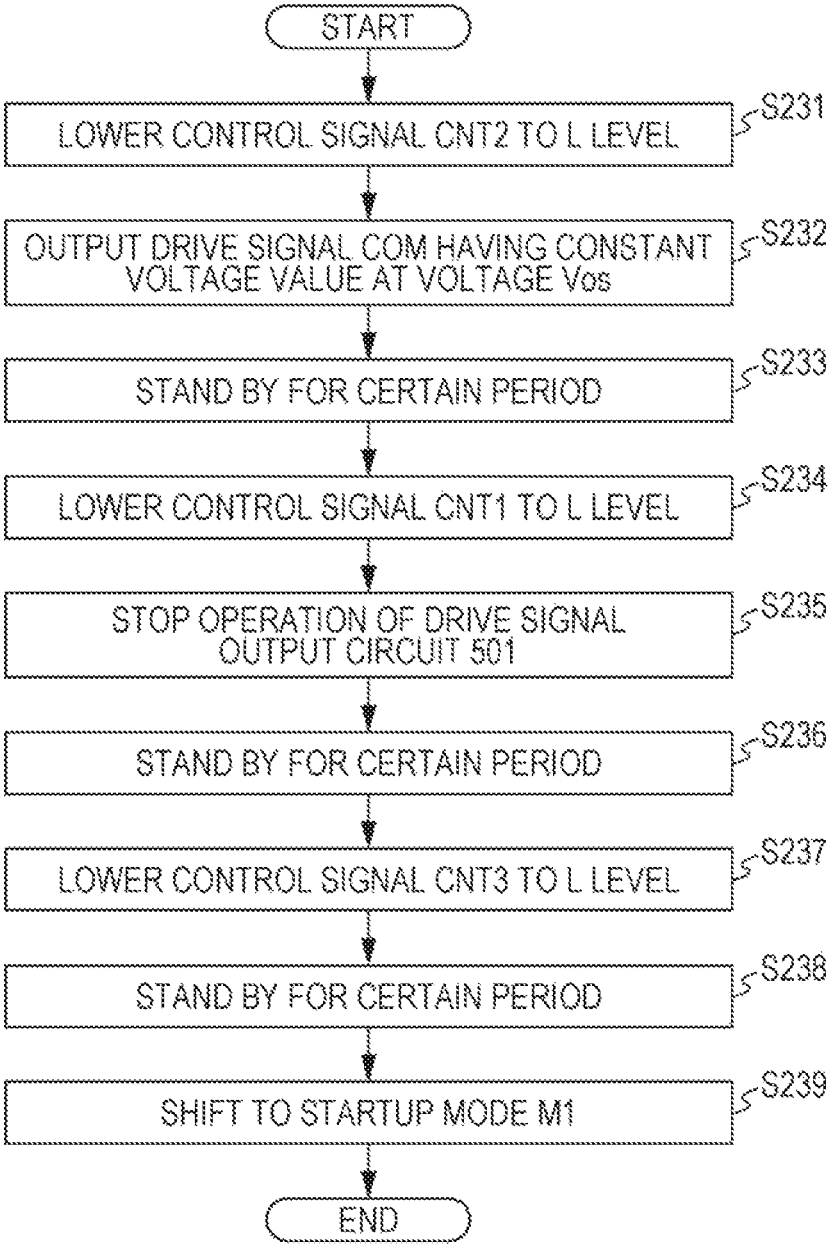
FIG. 26 is a diagram illustrating a sequence control of a first stop sequence.

FIG. 26 is a diagram illustrating a sequence control of the first stop sequence S230. When the liquid ejecting apparatus 1 is in the first standby mode M2 and state transition information for state transition to the startup mode M1 is held in the sequence register 441, the register control circuit 440 executes the first stop sequence S230.

By executing the first stop sequence S230, the register control circuit 440 lowers the control signal CNT2 to an L level (S231). Thereby, output of reference voltage signal VBS from reference voltage signal output circuit 460 stops. The register control circuit 440 controls the drive signal output circuit 501 to generate the drive signal COM having a constant voltage value at the voltage Vos. That is, the drive signal output circuit 501 outputs the drive signal COM having the constant voltage value at the voltage Vos (S232). The register control circuit 440 holds the drive control circuit 51 in this state for a certain period. In other words, the sequence control of the drive control circuit 51 is caused to stand by for a certain period (S233).

Thereafter, the register control circuit 440 lowers the control signal CNT1 to an L level (S234). Thereby, release of electric charges stored in the terminal COM-Dis starts. After the release of the electric charges stored in the terminal COM-Dis starts, the register control circuit 440 controls the drive signal output circuit 501 to stop the self-excited oscillation. That is, the drive signal output circuit 501 stops an operation (S235). The register control circuit 440 holds the drive control circuit 51 in this state for a certain period. In other words, the sequence control of the drive control circuit 51 is caused to stand by for a certain period (S236).

After the certain period elapses, the register control circuit 440 lowers the control signal CNT3 to an L level (S237). Thereby, supply of the voltage signal VHV2 to the print head 21 stops. The register control circuit 440 holds the drive control circuit 51 in this state for a certain period. In other words, the sequence control of the drive control circuit 51 is caused to stand by for a certain period (S238). After the certain period elapses, transition to the startup mode M1 is performed in the liquid ejecting apparatus 1. Thus, the drive control circuit 51 enters the startup mode M1 (S239).

Next, the second stop sequence S430, which is a state transition from the second standby mode M4 to the startup mode M1, will be described with reference to FIG. 27.

Figure 27:
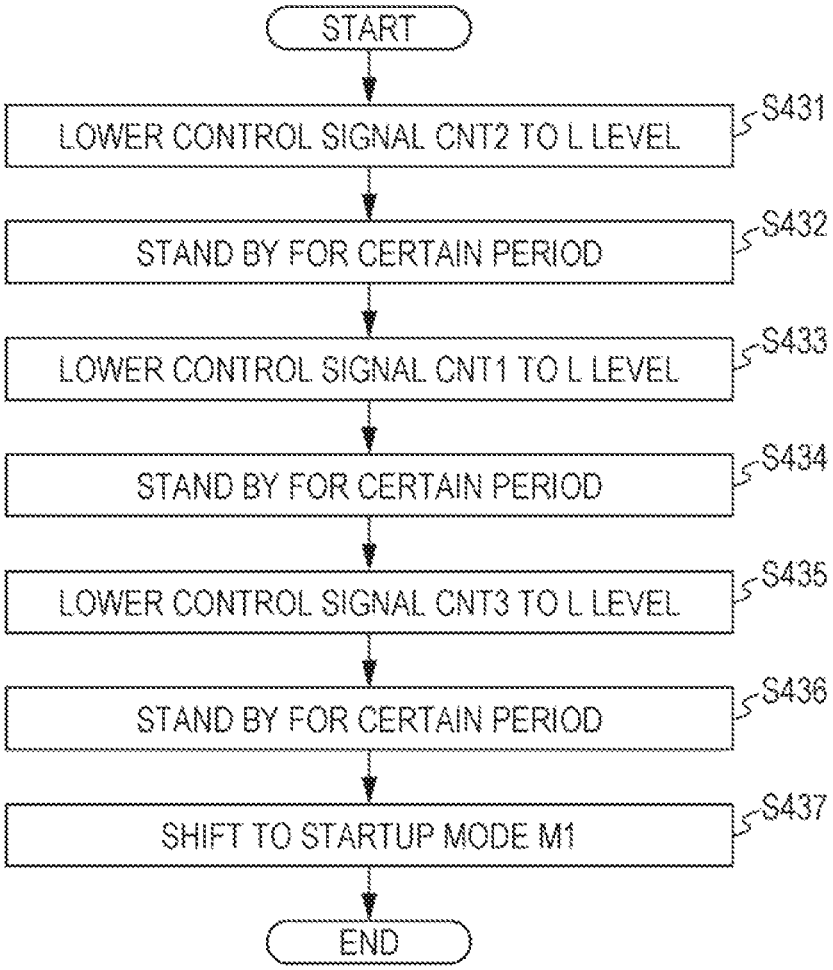
FIG. 27 is a diagram illustrating a sequence control of a second stop sequence.

FIG. 27 is a diagram illustrating a sequence control of the second stop sequence S430. When the liquid ejecting apparatus 1 is in the second standby mode M4 and state transition information for state transition to the startup mode M1 is held in the sequence register 441, the register control circuit 440 executes the second stop sequence S430.

By executing the second stop sequence S430, the register control circuit 440 lowers the control signal CNT2 to an L level (S431). Thereby, the reference voltage signal output circuit 460 stops outputting the reference voltage signal VBS. The register control circuit 440 holds the drive control circuit 51 in this state for a certain period. In other words, the sequence control of the drive control circuit 51 is caused to stand by for a certain period (S432).

After the certain period elapses, the register control circuit 440 lowers the control signal CNT1 to an L level (S433). Thereby, release of electric charges stored in the terminal COM-Dis starts. The register control circuit 440 holds the drive control circuit 51 in this state for a certain period. In other words, the sequence control of the drive control circuit 51 is caused to stand by for a certain period (S434).

After the certain period elapses, the register control circuit 440 lowers the control signal CNT3 to an L level (S435). Thereby, supply of the voltage signal VHV2 to the print head 21 stops. The register control circuit 440 holds the drive control circuit 51 in this state for a certain period. In other words, the sequence control of the drive control circuit 51 is caused to stand by for a certain period (S436). After the certain period elapses, transition to the startup mode M1 is performed in the liquid ejecting apparatus 1. Thus, the drive control circuit 51 enters the startup mode M1 (S437).

As described above, in the liquid ejecting apparatus 1 according to the present embodiment, the state transitions among the startup mode M1, the first standby mode M2, the printing mode M3, and the second standby mode M4 are performed by the sequence control executed by the register control circuit 440. By executing the sequence control of the liquid ejecting apparatus 1 according to the above-described sequence, a possibility that unintended stress is generated in the piezoelectric element 60 and a possibility that a reverse voltage is applied to the piezoelectric element 60 are reduced even during a period in which the liquid ejecting apparatus 1 performs the state transition.

6. Action and Effect

In the liquid ejecting apparatus 1 and the drive circuit 50 according to the present embodiment described above, before the reference voltage signal output circuit 460 starts to output the reference voltage signal VBS, the terminal TG-In and the terminal TG-Out of the selection circuit 230 are controlled to be non-conductive, and the drive signal output circuit 501 outputs the voltage signal VCNT having a constant voltage value at the voltage Vcnt.

When the reference voltage signal output circuit 460 starts to output the reference voltage signal VBS in a state in which the terminal TG-In and the terminal TG-Out of the selection circuit 230 are controlled to be non-conductive, a potential of the electrode 611 rises as the reference voltage signal VBS is supplied to the electrode 612. In this case, the potential of the electrode 611 may be reduced due to a leakage current flowing from the terminal TG-Out of the selection circuit 230 to the terminal TG-In thereof, and as a result, a possibility that a reverse voltage is supplied to the piezoelectric element 60 is reduced.

In contrast to this, before the reference voltage signal output circuit 460 starts to output the reference voltage signal VBS, the drive signal output circuit 501 outputs the voltage signal VCNT having a constant voltage value at the voltage Vcnt, and thus, a leakage current flowing from the terminal TG-Out of the selection circuit 230 to the terminal TG-In thereof is reduced. As a result, a possibility that the potential of the electrode 611 is reduced is reduced, and a possibility that a reverse voltage is supplied to the piezoelectric element 60 is reduced. Thus, a possibility that disorder in a polarization direction occurs in the piezoelectric element 60 is reduced, and a possibility that piezoelectric characteristics of the piezoelectric element 60 are degraded and the piezoelectric element 60 abnormally operates is reduced.

7. Modification Example

In FIGS. 20 to 27, when the liquid ejecting apparatus 1 performs a state transition from the printing mode M3 to the second standby mode M4, the transition is made via the first standby mode M2, but the liquid ejecting apparatus 1 may perform a direct state transition between the printing mode M3 and the second standby mode M4. Further, even when the liquid ejecting apparatus 1 has a configuration in which the direct state transition can be performed between the printing mode M3 and the second standby mode M4, in a case where the liquid ejecting apparatus 1 performs transition from the printing mode M3 to the second standby mode M4, the drive signal output circuit 501 may control the voltage value of the drive signal COM to approach the voltage value of the reference voltage signal VBS. Thereby, even when the liquid ejecting apparatus 1 can perform the direct state transition between the printing mode M3 and the second standby mode M4, it is possible to obtain the same action and effect as in the above-described embodiment.

As such, although embodiments and modification examples are described above, the present disclosure is not limited to the embodiments and can be implemented in various forms without departing from the gist of the disclosure. For example, the above embodiments can be appropriately combined.

The present disclosure includes substantially the same configuration (for example, a configuration having the same function, method, and result, or a configuration having the same object and effect) as the configuration described in the embodiment. Further, the present disclosure includes a configuration in which a non-essential portion of the configuration described in the embodiment is replaced. Further, the present disclosure includes a configuration having the same action and effect as in the configuration described in the embodiment or a configuration capable of achieving the same object. Further, the present disclosure includes a configuration in which a known technology is added to the configuration described in the embodiment.

What is claimed is:

1. A drive circuit for driving a piezoelectric element having a first terminal and a second terminal, the drive circuit comprising:

a drive signal output circuit that outputs a drive signal supplied to the piezoelectric element and a first constant voltage signal that is constant at a first voltage value and that is supplied to the piezoelectric element;

a switch circuit having one end electrically coupled to an output terminal of the drive signal output circuit and the other end electrically coupled to the first terminal; and a reference voltage signal output circuit that is electrically coupled to the second terminal and outputs a second constant voltage signal which is constant at a second voltage value, wherein before the reference voltage signal output circuit starts to output the second constant voltage signal, the switch circuit is controlled so that the one end and the other end are non-conductive with each other, and the drive signal output circuit outputs the first constant voltage signal, and wherein the drive signal output circuit includes a modulation circuit that modulates an original drive signal into a modulation signal and outputs the modulation signal, an amplification circuit that amplifies the modulation signal and outputs an amplification modulation signal, a demodulation circuit that demodulates the amplification modulation signal and outputs the drive signal, and a constant voltage signal output circuit that outputs the first constant voltage signal.

2. The drive circuit according to claim 1, wherein, after the reference voltage signal output circuit starts to output the second constant voltage signal, the demodulation circuit outputs the drive signal that is constant at a third voltage value.

3. The drive circuit according to claim 1, wherein the demodulation circuit outputs the drive signal of which voltage value for driving the piezoelectric element varies.

4. The drive circuit according to claim 3, wherein a difference between the first voltage value and the second voltage value is less than a difference between a maximum voltage value of the drive signal of which voltage value varies and the second voltage value.

5. The drive circuit according to claim 3, wherein a difference between the first voltage value and the second voltage value is less than a difference between a minimum voltage value of the drive signal of which voltage value varies and the second voltage value.

6. The drive circuit according to claim 1, wherein, before the reference voltage signal output circuit starts to output the second constant voltage signal, a power supply voltage is supplied to the switch circuit.

7. A liquid ejecting apparatus comprising:

a liquid ejecting head that includes the piezoelectric element and ejects a liquid by driving the piezoelectric element; and the drive circuit according to claim 1.

8. A drive circuit for driving a piezoelectric element having a first terminal and a second terminal, the drive circuit comprising:

a drive signal output circuit that outputs a drive signal supplied to the piezoelectric element and a first constant voltage signal that is constant at a first voltage value and that is supplied to the piezoelectric element;

a switch circuit having one end electrically coupled to an output terminal of the drive signal output circuit and the other end electrically coupled to the first terminal; and a reference voltage signal output circuit that is electrically coupled to the second terminal and outputs a second constant voltage signal which is constant at a second voltage value, wherein before the reference voltage signal output circuit starts to output the second constant voltage signal, the switch circuit is controlled so that the one end and the other end are non-conductive with each other, and the drive signal output circuit outputs the first constant voltage signal, and wherein a difference between the first voltage value and the second voltage value is less than a difference between an average voltage value of the drive signal and the second voltage value.

* * * * *